US010422187B2

(12) United States Patent
Roodenburg et al.

(10) Patent No.: US 10,422,187 B2
(45) **Date of Patent: *Sep. 24, 2019**

(54) OFFSHORE DRILLING VESSEL

(71) Applicant: Itrec B.V., Schiedam (NL)

(72) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/893,299

(22) Filed: Feb. 9, 2018

(65) Prior Publication Data

US 2018/0163484 A1 Jun. 14, 2018

Related U.S. Application Data

(63) Continuation of application No. 15/017,429, filed on Feb. 5, 2016, now Pat. No. 9,920,580, which is a (Continued)

(51) Int. Cl.
*E21B 15/02* (2006.01)
*B63B 35/44* (2006.01)

(Continued)

(52) U.S. Cl.
CPC ..... *E21B 15/02* (2013.01); *B63B 21/507* (2013.01); *B63B 27/04* (2013.01); *B63B 35/44* (2013.01);

(Continued)

(58) Field of Classification Search
CPC ..... E21B 15/02; E21B 19/16; E21B 19/004; E21B 19/02; E21B 19/155; E21B 19/006;

(Continued)

(56) References Cited

U.S. PATENT DOCUMENTS 2,420,803 A 5/1947 Tobin
3,368,509 A 2/1968 Knight, Jr. et al.

(Continued)

FOREIGN PATENT DOCUMENTS

CN 1137997 A 12/1996
CN 1404452 A 3/2003

(Continued)

OTHER PUBLICATIONS

Offshore Energy Today.Com:https://www.offshoreenergytoday.com/end-of-the-line-for-jasper-explorer-drillship/ (retrieved from the internet on Feb. 18, 2019) (Year: 2019).*

(Continued)

*Primary Examiner* — Anthony D Wiest
(74) *Attorney, Agent, or Firm* — Birch, Stewart, Kolasch & Birch, LLP

(57) ABSTRACT

An offshore drilling vessel including a hull having a moonpool, a bow and a stern, an accommodation topside having crew quarters and a bridge, said accommodation topside being arranged on the hull at the bow, a main deck between the accommodation topside and the stern of the vessel, wherein a front main deck portion of the main deck extends forward of the moonpool and a rear main deck portion of the main deck extends rearward of the moonpool, a firing line hoist system mounted on the hull at said moonpool, including a drilling structure, a hoisting device supported by the drilling structure and having a load attachment device displaceable along a firing line, the hoisting device including one or more cables and one or more associated winches to manipulate the position of the load attachment device relative to the drilling structure, one or more pivotal burner booms, each burner boom having an inner portion pivotally mounted at a lateral side of the hull and an outer portion supporting a burner, the burner boom being pivotable (Continued)

between a storage position generally parallel to the side of the hull and an operative position wherein the boom is directed away from the hull, the burner boom in the storage position being lower than the level of the main deck.

28 Claims, 18 Drawing Sheets

Related U.S. Application Data continuation of application No. 14/061,454, filed on Oct. 23, 2013, now Pat. No. 9,284,025, which is a continuation of application No. 12/867,658, filed as application No. PCT/NL2009/000033 on Feb. 13, 2009, now Pat. No. 8,590,474.

(60) Provisional application No. 61/071,450, filed on Apr. 29, 2008, provisional application No. 61/064,105, filed on Feb. 15, 2008.

(51) Int. Cl.

| | |
|---|---|
| ***E21B 19/00*** | (2006.01) |
| ***E21B 19/02*** | (2006.01) |
| ***B63B 3/14*** | (2006.01) |
| ***E21B 19/14*** | (2006.01) |
| ***E21B 19/15*** | (2006.01) |
| ***E21B 19/09*** | (2006.01) |
| ***B63B 27/04*** | (2006.01) |
| ***B63B 21/50*** | (2006.01) |
| ***E21B 19/16*** | (2006.01) |

(52) U.S. Cl.
CPC ..... *B63B 35/4413* (2013.01); *E21B 19/002* (2013.01); *E21B 19/004* (2013.01); *E21B 19/006* (2013.01); *E21B 19/02* (2013.01); *E21B 19/09* (2013.01); *E21B 19/143* (2013.01); *E21B 19/155* (2013.01); *E21B 19/16* (2013.01); *B63B 2003/147* (2013.01)

(58) Field of Classification Search
CPC ..... E21B 19/09; E21B 19/143; E21B 19/002; B63B 21/507; B63B 27/04; B63B 35/44; B63B 35/4413; B63B 2003/147
See application file for complete search history.

(56) References Cited

U.S. PATENT DOCUMENTS

| | | | | |
|---|---|---|---|---|
| 3,919,958 | A | | 11/1975 | Graham et al. |
| 4,108,318 | A | | 8/1978 | Rode et al. |
| 4,202,653 | A | | 5/1980 | Moller |
| 4,618,286 | A | | 10/1986 | Michel et al. |
| 4,646,672 | A | * | 3/1987 | Bennett ..... B63B 35/4413 114/264 |
| 4,666,341 | A | | 5/1987 | Field et al. |
| 4,694,909 | A | | 9/1987 | Stephenson et al. |
| 4,762,185 | A | | 8/1988 | Simpson |
| 5,525,011 | A | | 6/1996 | Huang |
| 6,056,071 | A | | 5/2000 | Scott et al. |
| 6,056,478 | A | | 5/2000 | Martin et al. |
| 6,363,898 | B1 | | 4/2002 | Ripma et al. |
| 6,378,450 | B1 | | 4/2002 | Begnaud et al. |
| 6,763,898 | B1 | | 7/2004 | Roodenburg et al. |
| 6,766,860 | B2 | | 7/2004 | Archibald et al. |
| 6,871,609 | B2 | | 3/2005 | Roodenburg et al. |
| 6,926,103 | B1 | | 8/2005 | Roodenburg et al. |
| 7,814,992 | B2 | | 10/2010 | Olsen |
| 8,590,474 | B2 | | 11/2013 | Roodenburg et al. |

FOREIGN PATENT DOCUMENTS

| | | | |
|---|---|---|---|
| EP | 1040249 | B1 | 7/2001 |
| EP | 1496297 | A2 | 1/2005 |
| GB | 1468635 | | 3/1977 |
| WO | WO 02/18742 | A1 | 3/2002 |
| WO | WO 2004/020275 | A2 | 3/2004 |
| WO | WO 2005/059297 | A2 | 6/2005 |
| WO | WO 2007/093787 | A1 | 8/2007 |
| WO | WO 2008/121071 | A1 | 10/2008 |
| WO | WO 2009/048319 | A2 | 4/2009 |

OTHER PUBLICATIONS

Gaddy et al., "Jack Ryan drillship to use retractable thrusters, mux control systems", Oil & Gas Journal, Pennwell, Houston, TX, US, vol. 98, No. 48, Nov.27, 2000 (Nov. 27, 2000), pp. 38-42, XP001048880
International Search Report dated Sep. 28, 2010 for the PCT appliction No. PCT/NL2009/000033.

* cited by examiner

OFFSHORE DRILLING VESSEL

CROSS-REFERENCE TO RELATED APPLICATIONS

This application is a Continuation of U.S. application Ser. No. 15/017,429 filed on Feb. 5, 2016, which is a Continuation of U.S. application Ser. No. 14/061,454 filed on Oct. 23, 2013 (now U.S. Pat. No. 9,284,025, issued Mar. 15, 2016), which is a Continuation of U.S. application Ser. No. 12/867,658 filed on Nov. 15, 2010 (now U.S. Pat. No. 8,590,474, issued Nov. 26, 2013), which is the National Phase of PCT/NL2009/000033, filed on Feb. 13, 2009, which claims priority under 35 U.S.C. § 119(e) to Provisional Application Nos. 61/071,450 and 61/064,105 filed in the U.S., on Apr. 29, 2008 and Feb. 15, 2008, respectively. The entire contents of all of the above applications are hereby incorporated by reference.

FIELD OF THE INVENTION

The present invention relates to a monohull offshore drilling vessel, e.g. for oil and gas exploration, well servicing, etc.

BACKGROUND OF THE INVENTION

In U.S. Pat. No. 6,763,898 and WO02/18742, which are incorporated herein by reference, multiple firing line hoist systems to be mounted on the hull of a drilling vessel are disclosed. In general these known multiple firing line hoist systems comprise:

- a mast having a top side and a base connected to the hull of the drilling vessel, wherein the mast has a hollow construction with a first side and an opposed second side,
- a first hoisting device supported by the mast and having a load attachment device displaceable along a first firing line, which extends on the outside of and adjacent to the first side of the mast;
- a second hoisting device supported by the mast and having a load attachment device displaceable along a second firing line, which extends on the outside of and adjacent to the second side of the mast.

The first and second hoisting devices each include one or more cables and one or more associated winches, the winches preferably being disposed in the hollow construction of the mast, to manipulate the position of each of the load attachment devices relative to the mast.

OBJECT OF THE INVENTION

The present invention aims to propose solutions to make optimum use of the multiple firing line hoist system on a monohull drilling vessel.

The present invention also aims to propose an improved multiple firing line hoist system for a drilling vessel.

SUMMARY OF THE INVENTION

The present invention provides a monohull offshore drilling vessel comprising:

- a hull having a moonpool;
- a multiple firing line hoist system mounted on the hull at said moonpool, the multiple firing line hoist system comprising:

- a mast having a top side and a base connected to the hull of the drilling vessel, wherein the mast has a hollow construction with a first side and an opposed second side,
  - a first hoisting device supported by the mast and having a load attachment device displaceable along a first firing line, which extends on the outside of and adjacent to the first side of the mast;
  - a second hoisting device supported by the mast and having a load attachment device displaceable along a second firing line, which extends on the outside of and adjacent to the second side of the mast;

wherein the first and second hoisting devices each include one or more cables and one or more associated winches, the winches preferably disposed in the hollow construction of the mast, to manipulate the position of each of the load attachment devices relative to the mast.

It is noted that the first and second side of the mast preferably correspond to the front and rear side of the mast, wherein it is in general of no interest which of the first and second side is the front side.

As is preferred the mast has a rectangular cross-section.

As is preferred the mast has a contiguous outer wall, so that its interior is shielded from the weather.

Preferably the one or more winches of the first and second hoisting device are arranged within the mast, preferably at the lower end of the mast.

In a preferred embodiment a BOP (Blow Out Preventer) storage is present in the hull of the vessel adjacent the moonpool, and the first hoisting device is adapted for raising and lowering the usually extremely heavy BOP to the seabed.

As is preferred the vessel includes a mobile working deck that is provided at the first side of the mast, which in an active position covers a portion of the moonpool at said first side of the mast while the first firing line extends through said mobile working deck, and which in a non-active position allows the BOP to be brought in said first firing line and manipulated by the first hoisting device.

The mobile working deck preferably includes an opening therein that can be aligned with the first firing line, so that objects, e.g. a string of tubulars, e.g. a riser string, can be lowered through the deck into the sea, with the deck in its active position.

The mobile working deck preferably includes a suspension device arranged at the opening in the deck, said suspension device being adapted to connect to and support the top end of a string of tubulars, most preferably a riser string with a BOP attached to the lower end of the riser string. This suspension device may include a clamping device or similar to suspend a string of tubulars from the deck, e.g. a device known as a riser spider. It will be appreciated that in this preferred embodiment the mobile working deck, in its active position, is supporting the weight of the suspended string of tubulars. In a practical embodiment said weight will be at least 200 tonnes, so the working deck has a structure allowing to support a string of tubulars, e.g. risers, possibly with a BOP attached to the lower end of the string, having a weight of at least 200 tonnes.

The mobile working deck may also include a rotary table arranged at the opening in the deck, possibly combined with the riser spider.

Preferably the working deck is provided with support means, e.g. rails, for an iron roughneck. The iron roughneck may be arranged permanently on the working deck. It is preferred to provided the mast with a storage compartment for the iron roughneck at the side of the mobile working deck, so that the iron roughneck can be stored in said compartment when not in use, e.g. the compartment having rails that may be aligned with the rails on the working deck to move the iron roughneck over the rails.

By arranging the mobile working deck in a mobile manner the deck can be in a relative low position with respect to the waterline when work has to be carried out on the working deck, e.g. assembly of a riser string or a drill string. If this deck were mounted stationary, the BOP would have to be brought under the stationary deck, and as the BOP is usually very tall, this would necessitate a working deck to be mounted at a significant height above the waterline. So by arranging the deck in a mobile manner it can be ensured that the deck is at an advantageous low height when work is carried out on said working deck.

In a possible embodiment, the mobile working deck is provided with lifting means, so that in a raised non-active position of the mobile working deck the BOP can be brought underneath the mobile working deck. In a possible embodiment the mast is provided with one or more vertical guides along which the mobile deck is displaceable between the active position and a raised non-active position. An associated winch or winches with one or more cable connected to the working deck may be provided to raise and lower the working deck.

In another embodiment of a liftable working deck it is envisaged that the lifting of the working deck is done with the hoisting device of the multiple firing line hoist system that is arranged at the side of the mobile working deck or with a crane of the vessel. The mast may then be provided with a deck holding device at an elevated position along the mast to hold the deck in the raised, non-active position.

In another embodiment the mobile deck is arranged pivotally, so that e.g. it can be brought in a vertical non-active position. For instance the mobile deck may have two pivotable deck parts.

It is preferred that the vessel has a stationary working deck at the second side of the mast, and that the active position of the mobile working deck is at substantially the same height as the stationary working deck. This is most preferred if the vessel is provided with one or more setbacks, e.g. carrousels, for joints of drill pipes, e.g. at both lateral sides of the mast, so that drill pipe joints can easily be transferred from each of said setbacks to either firing line.

It is noted that a different height of working decks at opposed sides of the mast is also possible within the scope of this application.

In a preferred embodiment the mobile working deck is movable in the plane of the mobile working deck, e.g. movable in lateral direction, so that in a non-active position of the mobile working deck the deck is cleared from the first firing line. The deck may be composed of several deck members, e.g. movable in different lateral directions, if desired.

Preferably a skidding structure is provided for the mobile working deck, so that the working deck is skiddable between the active and non-active position.

Preferably the working deck is laterally displaceable between the active and non-active or retracted position.

In a preferred embodiment the BOP storage is offset, preferably laterally offset, from the first firing line, and a BOP transfer device is provided for displacement of the BOP into the first firing line.

In a possible embodiment the BOP transfer device includes a set of rails on the hull of the vessel, and a BOP support frame is displaceable over said rails.

Preferably the BOP support frame has a central opening for the BOP to extend through, so that a top portion of the BOP extends above the BOP support frame and a lower portion below the BOP support frame. Supporting the BOP in this manner results in a stable holding of the BOP, e.g. advantageous over a solution where the BOP is supported on the underside or supported from the upper end.

In a preferred embodiment the BOP support frame is provided with actuable BOP supports that in active position support the BOP and in retracted position release the BOP (commonly after it has been attached to a riser held by the first hoisting device).

In a possible embodiment the BOP is composed of a lower main body element and an upper main body element having connectors so that said BOP is splittable into said two main body elements.

For handling a splittable BOP the vessel may have storages for the lower main body element and upper main body element at distinct locations, for example the storage of the upper main body element being at a level above the top of the stored lower main body element and preferably offset horizontally from said stored lower main body element.

For handling a splittable BOP the BOP transfer device may include a first and a second support frame. The first support frame being displaceable, e.g. skiddable, over a first set of rails, e.g. lateral rails, supported on the hull of the vessel and extending from the storage of the lower main body element to above the moonpool. In a preferred embodiment lateral rails extending a distance beyond both lateral side of the moonpool, most preferably a BOP storage (for a lower main body element or an entire non-splittable or non-splitted BOP) being present on both lateral sides of the moonpool that are reached by the rails. The first support frame has a second set of rails upon which the second support frame is positionable, so that the second support frame is then resting on the first support frame, e.g. the second set of rails extending in longitudinal direction. The hull of the vessel is provided with a third set of rails at the storage of the upper main body element. By suitable positioning the first support frame, the second set of rails can be aligned with the third set of rails so that the upper main body element can be moved from its storage with the second support frame and then brought onto the first support frame. The upper and lower main body element can then be interconnected and thus supported by the combination of the first and second support frames.

The upper main body element may be a LMRP (Lower Marine Riser Package) and the lower main body element a SSBOP (subsea BOP) as is known in the art.

In a practical embodiment the top end of the stored lower main body element is vertically spaced from the stored upper main body element, and lifting means for the lower main body element are provided that allow to raise the lower main body element to the upper main body element so that these elements are interconnectable. Preferably the lifting means are designed to engage on a lower side of the lower body element and push it upwards. In a practical embodiment the vessel is provided with a BOP test stump on which the BOP may be stored, wherein the lifting means are positioned adjacent to or integrated with the test stump.

In a possible embodiment the vessel is equipped with a vertical riser storage for storage of riser in vertical orientation essentially within the hull of the vessel. Preferably the vessel has a working deck at the first side of the mast which covers a portion of the moonpool at said first side of the mast while the first firing line extends through said working deck, and the vertical riser storage is such that the top end of the risers is below the level of the working deck.

In a preferred embodiment a riser manipulator is arranged in the vertical riser storage and is located adjacent the first firing line, said riser manipulator being adapted to receive a riser in vertical orientation, tilt said riser to an inclined orientation so that the upper end thereof is directed towards the first firing line, and raise the tilted riser so that the upper end thereof arrives in the first firing line thus allowing the upper end to be connected to the load attachment device of the first hoisting device for further handling of the riser by said first hoisting means.

In a practical embodiment the riser manipulator includes an elongated tiltable riser support member with associated tilting means (e.g. one or more hydraulic cylinders), preferably having a tilt axis near a lower end of the riser support member.

Preferably the riser manipulator has a length corresponding to the length of the riser so that said riser is supported over its length.

Preferably the working deck (which may be the mobile working deck as explained above) is provided with a riser opening remote from the first firing line, so that the tilted riser may be moved towards the first firing line through said riser opening in the working deck.

In a possible embodiment the vessel comprises a riser handling gantry crane provided with riser hoisting device that allows to raise and lower a riser and displace said riser—while maintaining vertical orientation—to and from a riser manipulator.

Preferably the vessel is provided with a rotary drilling drive, e.g. a top drive, at the second side of the mast and/or the first side of the mast.

In a possible embodiment the vessel comprises one of more holds in the hull for storing drill string cassettes, a cassette having multiple parallel storage slots open from above, each slot adapted to store a stack of multiple drill strings.

On the vessel a rail system with one or more rails and one or more associated trolleys may be provided, which rails extend from one or more holds in the hull to the side(s) of the mast where a rotary drilling drive is present. It is noted that these rails may also be used for other purposes, e.g. transportation of other drilling equipment, etc.

In a preferred embodiment a crane is mounted near each side of the mast equipped with a rotary drilling drive, the crane allowing lifting a cassette from a trolley and placing it in a storage position near said side of the mast, wherein the cassette is stored in horizontal orientation.

Preferably a drill string manipulator is arranged at said side equipped with a rotary drilling drive of the mast to remove a drill string from a cassette in horizontal orientation.

In a practical embodiment the vessel has one or more holds that comprise vertically spaced floors for storage of cassettes, and wherein an elevator is provided to transfer a cassette upwards to the rail system.

The present invention also relates to a monohull offshore drilling vessel comprising:

a hull with a bow and a stern, an accommodation topside having crew quarters and a bridge, said accommodation topside being arranged on the hull at the bow, the hull having a main deck between the accommodation topside and the stern of the vessel, a moonpool extending through the hull, wherein a front main deck portion of the main deck extends forward of the moonpool and a rear main deck portion of the main deck extends rearward of the moonpool, a multiple firing line hoist system mounted on the hull, the multiple firing line hoist system comprising:

a hollow construction mast having a top side and a base integral with the hull, the base extending between sections of the hull on port and starboard side of the moonpool, the base being spaced from the bow side and from the stern side of the moonpool, thereby forming a front moonpool area forward of the mast and a rear moonpool area rearward of the mast, wherein the mast has a front side and an opposed rear side as well as opposed lateral sides, a first hoisting device supported by the mast and having a load attachment device displaceable along a first firing line, which extends on the outside of and adjacent to the rear side of the mast, so as to allow handling of items passing through the rear moonpool area;

a second hoisting device supported by the mast and having a load attachment device displaceable along a second firing line, which on the outside of and adjacent to the front side of the mast, so as to allow handling of items passing through the front moonpool area;

wherein the first and second hoisting devices each include one or more cables and one or more associated winches to manipulate the position of each of the load attachment devices relative to the mast.

This vessel may be provided with features according to one or more of the subclaims of this application.

The present invention also relates to a monohull drilling vessel, having a hull, which hull has a bow and a stern, an accommodation topside having crew quarters and a bridge, said accommodation topside being arranged on the hull at the bow, a main deck between the accommodation topside and the stern of the vessel, and wherein a front main deck portion of the main deck extends forward of the moonpool and a rear main deck portion of the main deck extends rearward of the moonpool, wherein a drilling structure, e.g. a mast or a derrick is provided at the moonpool, said vessel having one or more of the features according to the subclaims of this application, for instance having one or more of:

the hull comprises an engine room below the accommodation topside, the engine room containing one or more fuel powered engines and generators driven by said one or more engines to provide on-board power, at least for one or more electric motors of electric thrusters providing propulsion for the vessel, and wherein one or more exhausts associated with the one or more engines extend upward to one or more exhaust outlets above the accommodation topside, the vessel has one or more pivotal burner booms, each burner boom having an inner portion pivotally mounted at a lateral side of the hull and an outer portion supporting a burner, the burner boom being pivotable between a storage position generally parallel to the side of the hull and an operative position wherein the boom is directed away from the hull, the burner boom in the storage position being lower than the level of the main deck, the burner boom preferably being located in a rear section of the lateral side of the hull, wherein preferably the lateral side of the hull has a recessed storage space for the burner boom, such that the stored burner boom does not projected beyond the plane of the lateral side of the hull of the vessel, wherein the main deck is provided with a rail transportation system having one or more rails and one or more associated trolleys, possibly wheeled trolleys with rail engaging wheels, and preferably said rail system including a track that extends in longitudinal direction of the main deck between the rear main deck portion and the front main deck portion and passes along a side of the moonpool, so allowing e.g. to transport items between the front and the rear main deck portion and to the area near the moonpool and the mast, and preferably a gantry crane extending over said track to handle items to be transported via said track.

It will be appreciated that the advantageous provided by these measures also are relevant for drilling vessel that are not equipped with the mast type multiple firing line hoisting system disclosed herein, but are e.g. equipped with a lattice work derrick placed over the moonpool, possibly the derrick containing two firing lines and associated drawworks for tubulars in the firing lines.

The present invention also relates to a multiple firing line hoisting system for mounting on an offshore drilling vessel, preferably a monohull vessel, but not excluding other hull type vessels such as a semi-submersible or otherwise, the hoisting system having:

a mast having a top side and a base connectable to the hull of the drilling vessel, wherein the mast has a hollow construction with a first side and an opposed second side, a first hoisting device supported by the mast and having a load attachment device displaceable along a first firing line, which extends on the outside of and adjacent to the first side of the mast;

a second hoisting device supported by the mast and having a load attachment device displaceable along a second firing line, which extends on the outside of and adjacent to the second side of the mast;

wherein the first and second hoisting devices each include one or more cables and one or more associated winches, the winches preferably disposed in the hollow construction of the mast, to manipulate the position of each of the load attachment devices relative to the mast, wherein the multiple firing line hoisting system further comprises one or more of the features disclosed in the subclaims of this application, for instance having one or more of:

the hollow construction of the mast being provided with a rotary drilling top drive storage compartment having an access opening for the top drive at the front and/or rear side of the mast, adapted to store a rotary drilling top drive when not in use, said storage compartment preferably being accessible for personnel via a stairs structure within the mast and/or an elevator within the mast, wherein preferably the storage compartment is equipped with a door to close the access opening, a movable support assembly with associated drive means being provided at the rotary drilling storage compartment, said support assembly in an extended position allowing to receive the rotary drilling top drive whilst in the firing line and in an retracted position allowing to support the top drive within the storage compartment, the hollow construction mast being internally provided with a personnel elevator, the mast being comprised of a lower mast section integral with the base, and a removable top mast section including sets of sheaves associated with the first and second hoisting devices respectively, wherein the lower mast section and the top mast section are interconnected by one or more releasable fastening devices, the mast being provided with an iron roughneck storage compartment having an access opening for the iron roughneck at the front side and/or rear side of the mast, adapted to store the iron roughneck when not in use, wherein preferably the storage compartment is equipped with a door to close the access opening.

The present invention also relates to a drilling vessel according to the combination of claims 1, 39 and 40 having another type of hull than a monohull, e.g. a semi-submersible having a deck box structure support by legs on parallel pontoons. It will be appreciated that the height reduction of the mast disclosed in the combination of these claims also applies to other types of drilling vessel, most in particular to semi-submersibles.

The present invention also relates to a method for operating the vessel. Preferred embodiments thereof are discussed in the description with reference to the drawings.

The invention will now be explained with reference to the appended drawings.

DETAILED DESCRIPTION OF PREFERRED EMBODIMENTS

Figure 1:
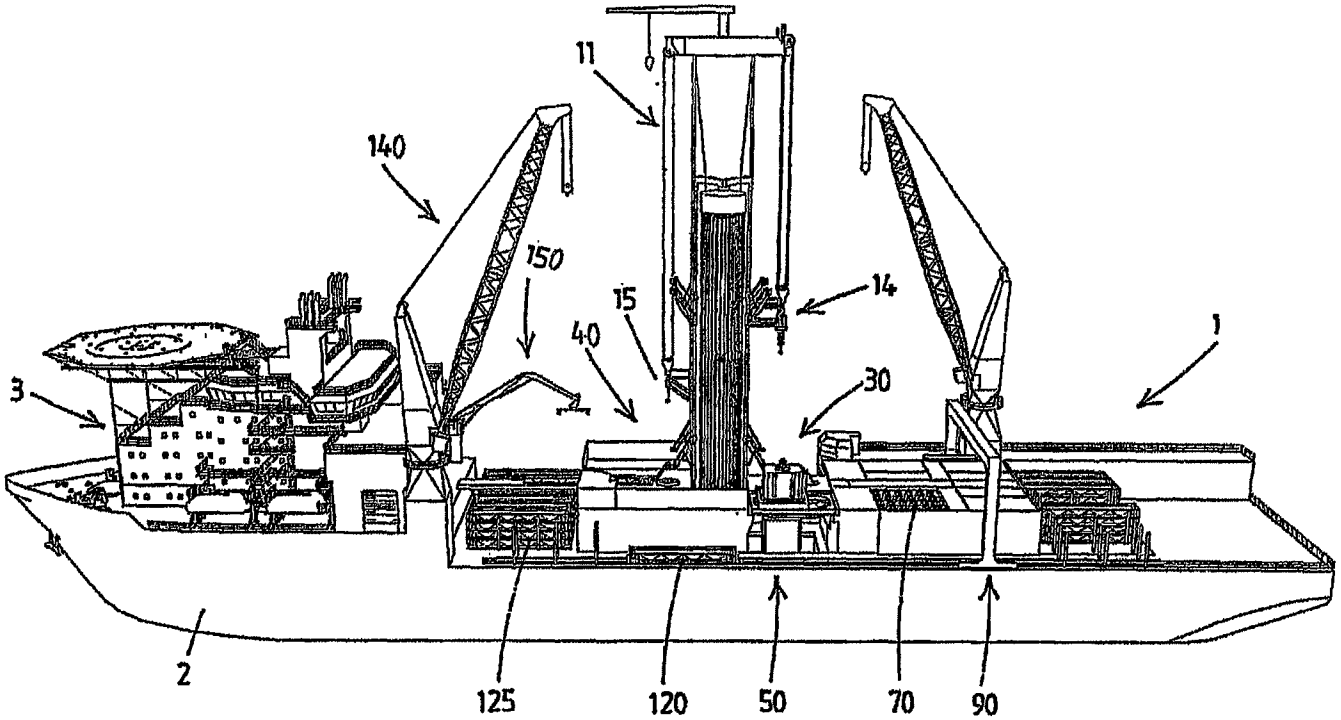
FIG. 1 shows a first example of a monohull drilling vessel according to the invention.
Figure 2:
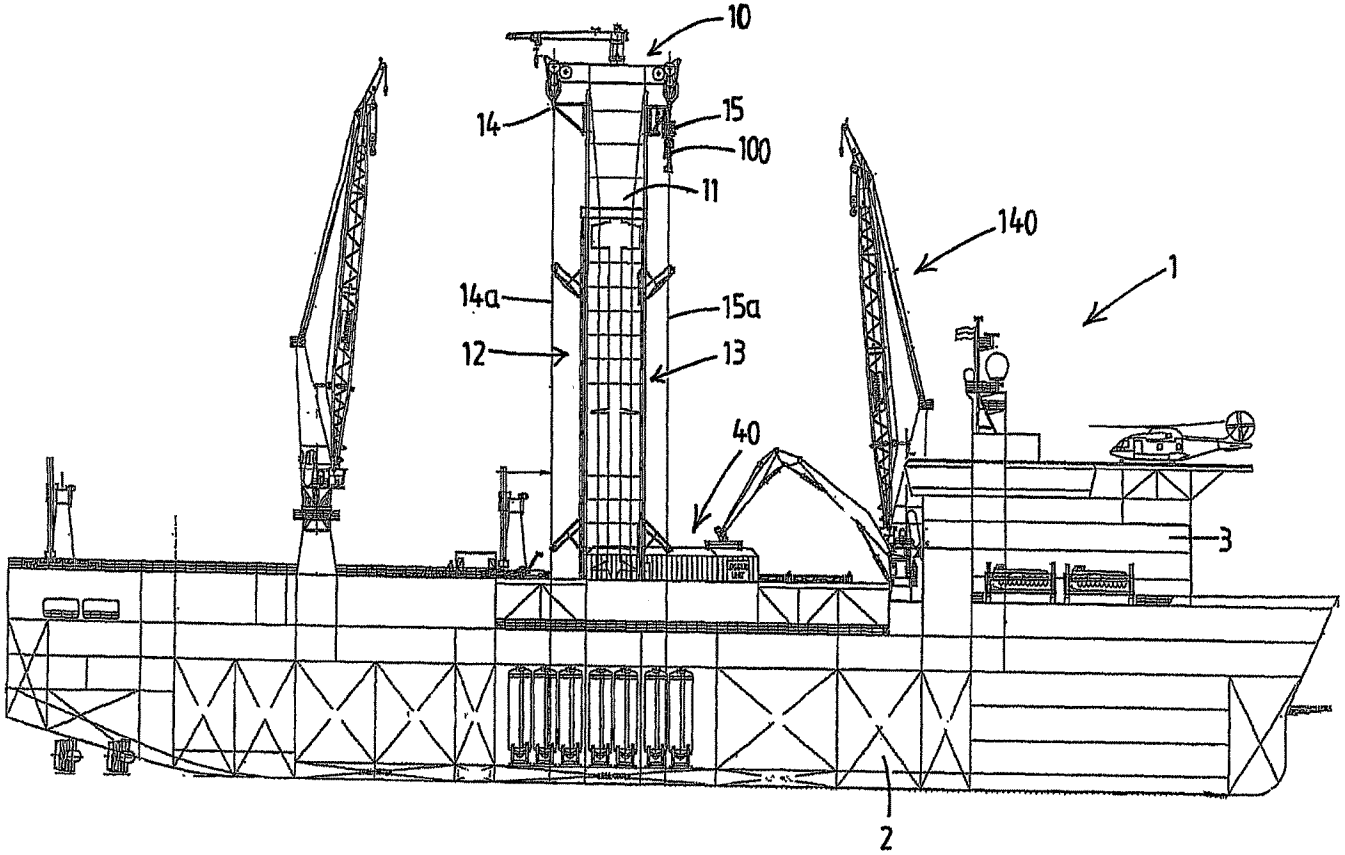
FIG. 2 shows a side view of the vessel of FIG. 1.
Figure 3:
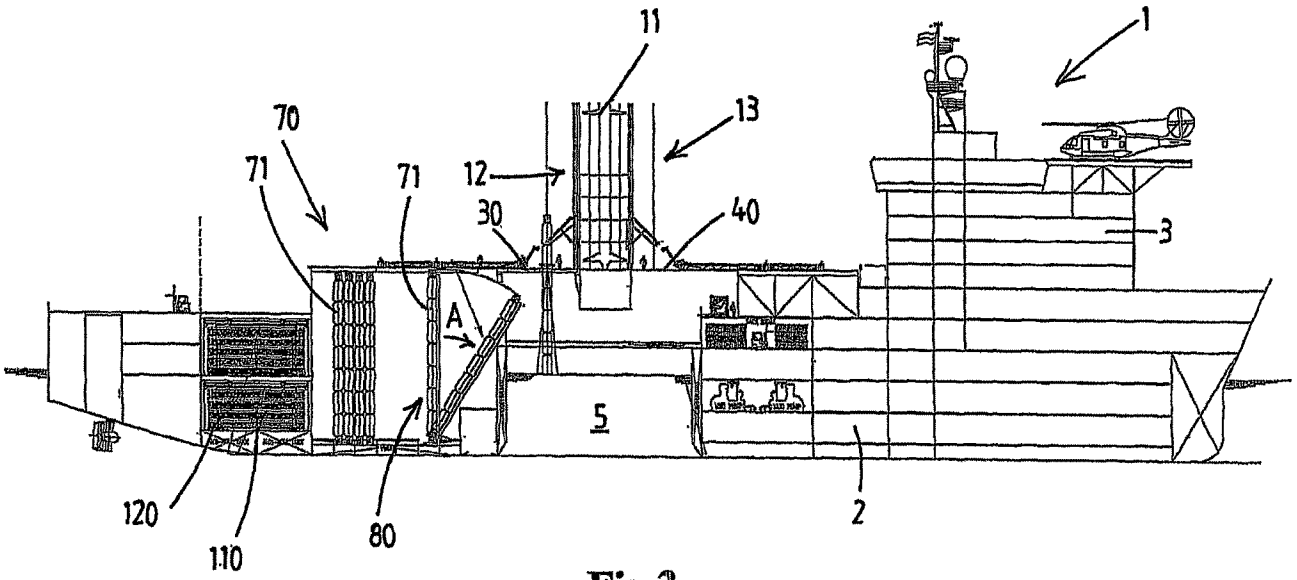
FIG. 3 shows a mid ship longitudinal cross-section of the vessel of FIG. 1.
Figure 4:
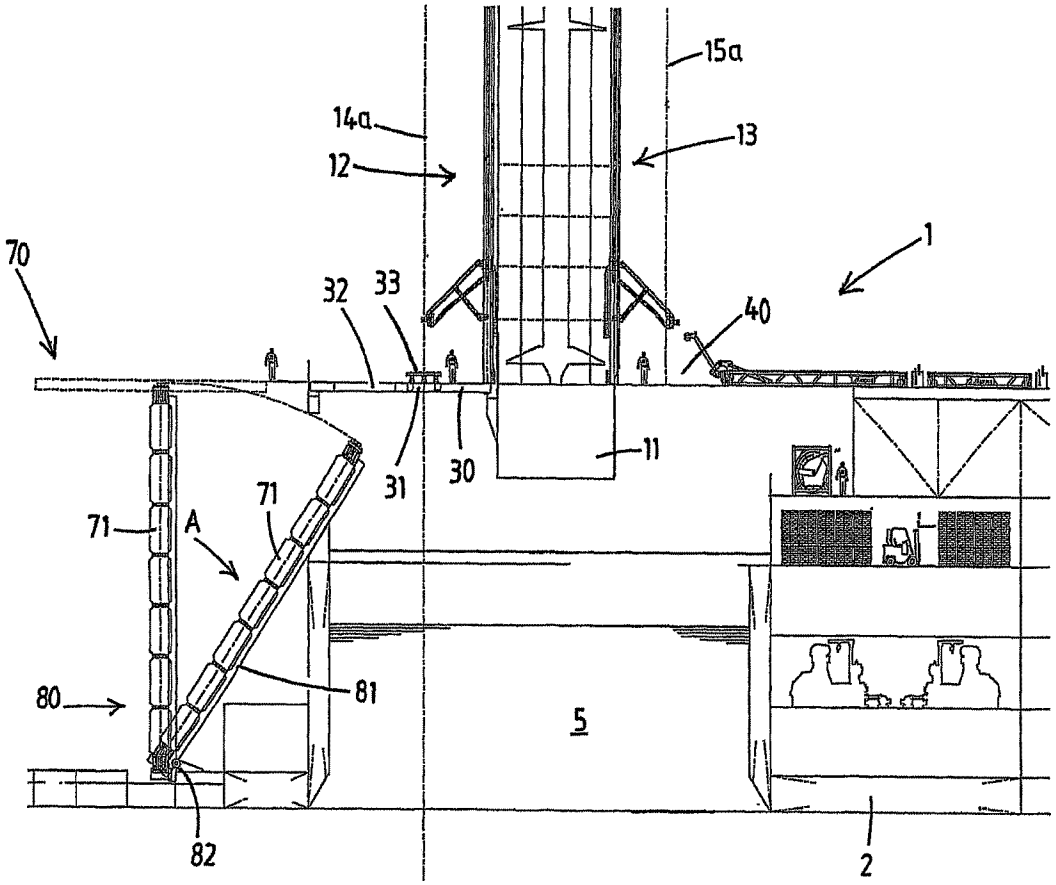
FIG. 4 shows a portion of FIG. 3 on a larger scale.

FIGS. 1-3 show a first preferred embodiment of a monohull offshore drilling vessel 1 that is suitable for offshore drilling, e.g. for oil and gas exploration, well servicing and/or other drilling related activities (e.g. servicing and/or placement of subsea equipment).

The hull 2 has crew quarters and a bridge 3 on the bow side, here with helicopter platform. In this example about halfway the length of the hull 2 the vessel 1 has a large moonpool 5.

Effectively above this moonpool 5 a multiple firing line hoist system 10 is mounted on the hull 2 so that—as preferred—a forward portion and a rear portion of the moonpool 5 are accessible at the front and the rear of the system 10.

The multiple firing line hoist system 10 comprises:

- a mast 11 having a top side and a base, which in this example as a transverse girder, is connected to the hull of the drilling vessel, wherein the mast 11 has a hollow construction with a first side 12 (in this example the rear side) and an opposed second side 13 (in this example the front side),
- a first hoisting device supported by the mast and having a load attachment device 14 displaceable along a first firing line 14*a*, which extends on the outside of and adjacent to the first side of the mast 11;
- a second hoisting device supported by the mast and having a load attachment device 15 displaceable along a second firing line 15*a*, which extends on the outside of and adjacent to the second side of the mast.

The first and second hoisting devices each include one or more cables and one or more associated winches to manipulate the position of each of the load attachment devices relative to the mast. The winches are preferably located in the mast, most preferably in the base of the mast, but other location are also possible.

Details of the mast and the hoisting devices can be derived from U.S. Pat. No. 6,763,898 which is incorporated herein by reference.

A BOP storage 20 is present in the hull of the vessel adjacent the moonpool 5, here at a lateral side of the moonpool.

The first hoisting device is adapted for raising and lowering the BOP to the seabed.

A mobile working deck 30 is provided at the rear side of the mast 11, which in an active position covers a portion of the moonpool 5 at said rear side of the mast 11 while the first firing line 14*a* extends through said mobile working deck (the deck has an opening 31 that can be aligned with the firing line 14*a*), and which in a non-active position allows the BOP to be brought in said first firing line and manipulated by the first hoisting device.

The vessel 1 has a stationary working deck 40 at the front side of the mast 11. In this laterally slidable version the working deck 30 it always at substantially the same height as the stationary working deck 40.

The mobile working deck 30 here is movable in lateral direction, so that in a non-active position of the mobile working deck 30 the deck is cleared from the first firing line 14*a* (see FIGS. 6A-6C and 7A-7C).

A skidding structure is provided for the mobile working deck, so that the working deck is skiddable between the active and non-active position.

The mobile working deck 30, as is preferred, includes a suspension device 33 arranged at the opening 31 in the deck, said suspension device 3 being adapted to connect to and support the top end of a string of tubulars, most preferably a riser string with a BOP attached to the lower end of the riser string. This suspension device 33 may include a clamping device or similar to suspend a string of tubulars from the deck, e.g. a device known as a riser spider. It will be appreciated that in this preferred embodiment the mobile working deck 30, in its active position, is capable to support the weight of the suspended string of tubulars.

As indicated the BOP storage 20 is laterally offset from the firing line 14*a*, and a BOP transfer device 50 is provided for lateral displacement of the BOP into the firing line 14*a*.

The BOP transfer device 50 includes a set of lateral rails 51, 52 on the hull of the vessel, and a BOP support frame 53 displaceable over said rails. As is preferred the working deck 30 is displaceable over the same rails 51, 52. The rails are spaced apart so as to allow the BOP to pass through.

The BOP support frame 53, rectangular in this example, has a central opening for the BOP to extend through, so that a top portion of the BOP extends above the BOP support frame and a lower portion below the BOP support frame 53 during transfer of the BOP to and from the firing line. This is preferred as it allows a safe transfer of the usually very heavy and tall BOP.

The BOP support frame 53 is provided with actuable BOP supports that in active position support the BOP and in retracted position release the BOP, so that the BOP may be lowered into the sea by means of the first hoisting device.

In this example the BOP is composed of a lower main body element 60 and an upper main body element 61 having connectors so that said BOP is splittable into said two main body elements. This is a known arrangement in the art as explained above.

The BOP support frame 53 is adapted to support the upper main body element 61 thereon during storage thereof, possibly via an intermediate frame.

The hull of the vessel is provided with a storage location 20 for the lower main body element 60, preferably provided with a so-called BOP test stump 62.

Figure 5A:
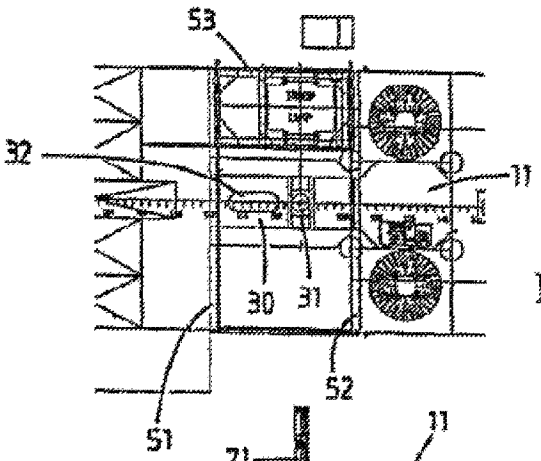
FIGS. 5A, 5B and 5C show a top view, longitudinal cross-section, and lateral cross-section of the vessel of FIG. 2 near the mast and moonpool to illustrate the BOP handling.
Figure 5B:
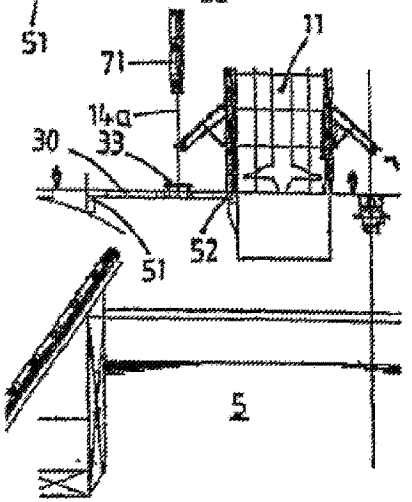
Figure 5C:
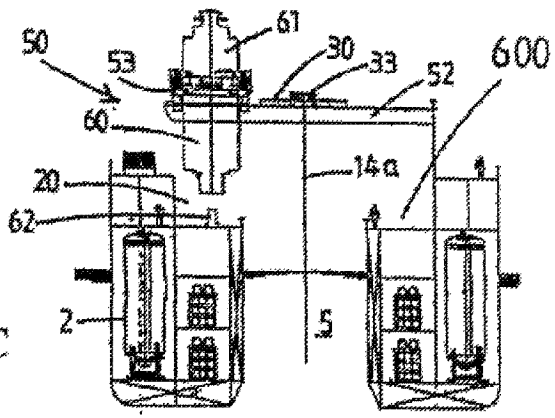
Figure 6A:
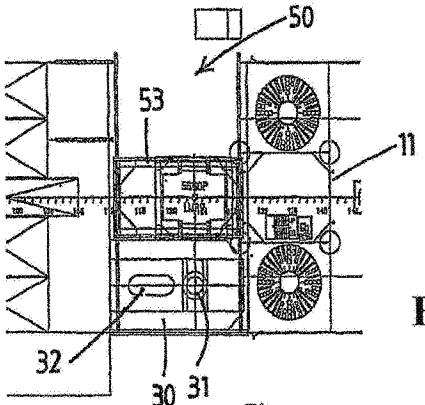
FIGS. 6A, 6B and 6C show the views of FIGS. 5A-5C in a further stage of the BOP handling.
Figure 6B:
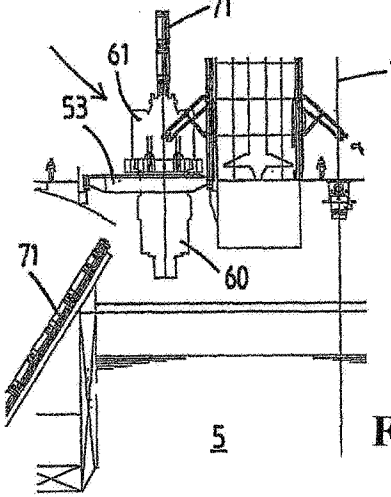
Figure 6C:
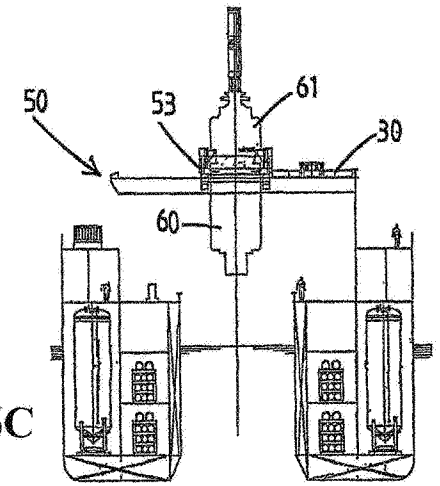
Figure 7A:
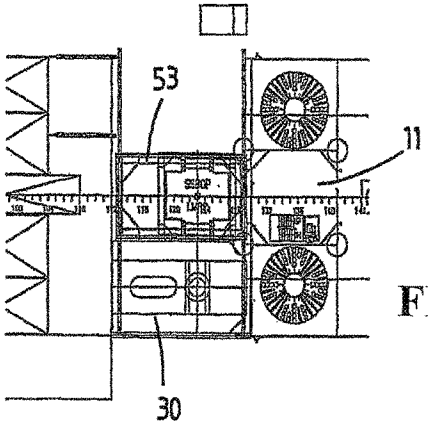
FIGS. 7A, 7B and 7C show the views of FIGS. 5A-5C and 6A-6C, in an even further stage of BOP handling.
Figure 7B:
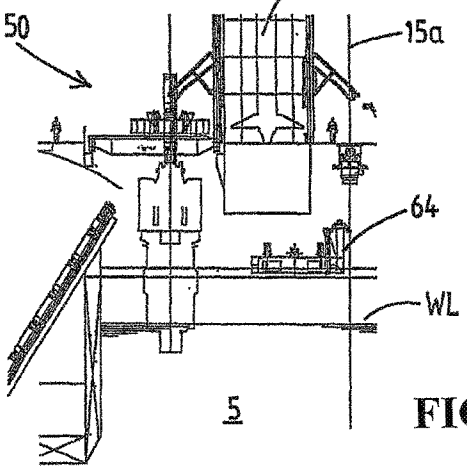
Figure 7C:
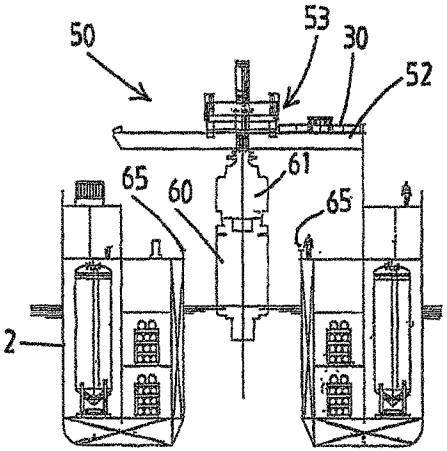

As can be derived from FIG. 5C the top end of the stored lower main body element 60 is vertically spaced from the stored upper main body element 61. To achieve the interconnection of the two elements it is preferred to provide lifting means for the lower main body element 60 that allow to raise the lower main body element to the upper main body element so that these elements are interconnectable.

The lifting means for the lower main body element 60 preferably are integrated with the test stump 62, allowing the test stump 62 while supporting the lower main body element 60 to be moved up and down in a controlled manner, e.g. as one or more hydraulic cylinders are integrated with the test stump 62.

In another, non shown, embodiment the vessel is adapted to store the lower main body element at one lateral side of the vessel and the upper main body element at the other lateral side of the vessel. Then the BOP transfer device could be used to arrange the lower main body in the firing line, which is the suspended from the first hoisting device, and then to collect the lower main body element and align it with the upper main body element, wherein the first hoisting device could then be used to lower the upper element onto the lower element.

As is highly preferred in a vessel with a moonpool and a multiple hoist system with two firing lines 14*a*, 15*a* extending through said moonpool, the vessel 1 is equipped with a suspended riser transfer device including a support frame 64 (see FIG. 7B), possibly embodied as a skid cart, and a pair of associated rails 65 which extend in longitudinal direction of the moonpool (see FIG. 7C) allowing to displace the support frame 64 in longitudinal direction of the moonpool while supporting a riser string of interconnected riser (and possibly a BOP attached to the lower end of the riser string) lowered into the sea, generally between the rear moonpool area and the front moonpool area, so as to pass underneath the base of the mast. The support frame 64 preferably has one or more mobile riser suspension members for suspending the riser string and attached BOP.

This support frame 64 may in addition have one or more actuable BOP support members, to directly support the BOP on the frame, e.g. similar to the manner in which frame 53 supports the BOP. Such a direct support of the BOP on the support frame 64 may be used for disconnecting the hoisting device 14 from the BOP after it has been lowered to be supported on the frame 64, so that the mobile working deck 30 can then be returned to its active position. The BOP may then be reattached to the hosting device 14 and raised with its top end to the level of the working deck 30, so as to suspend the BOP from a suspension device of the working deck 30. A riser may then be connected to the top end of the BOP and the entirety lowered by means of hoisting device 14 into the sea, so that the riser top end is then suspended from the working deck 30. Then risers can be added in the manner known in the art. When the riser string has reached a sufficient length, the top end of the riser string may be lowered to the support frame 64, so that the top end can be supported by the riser suspension member on said frame 64. Then the frame with the suspended riser string can be moved to the front firing line 15*a*.

At the front firing line the riser string can be attached to a direct acting riser tensioner device, or to a riser tensioner ring of a cable type riser tensioner system arranged on board of the vessel. As is known in the art these procedures may include the attachment of a slip joint or telescopic joint to the top end of the riser string, which step may also have been done at the firing line 14*a* when desired.

In FIGS. 1-5, 6A-6C and 7A-7C it can be recognized that the hull 2 of the vessel is provided with a vertical riser storage 70 for storage of risers 71 in vertical orientation.

The riser storage 71 extends deep into the hull 2 so that the top end of the risers 71 is below the level of the working deck 30.

A riser manipulator 80 is arranged in the vertical riser storage 70 and is located adjacent the firing line 14*a*, said riser manipulator 80 being adapted to receive a riser in vertical orientation, tilt said riser 71 to an inclined orientation (see arrow A in FIG. 3) so that the upper end thereof is directed towards the firing line 14*a*, and raise the tilted riser so that the upper end thereof arrives in the firing line 14*a* thus allowing the upper end to be connected to the load attachment means 14 of the first hoisting device for further handling of the riser by said first hoisting means.

The riser manipulator 80 includes an elongated tiltable riser support member 81 with associated tilting means, preferably having a tilt axis 82 near a lower end of the riser support member.

The working deck 30 is provided with a riser opening 32 remote from the first firing line, so that the tilted riser may be moved towards the firing line 14*a* through said riser opening 32 in the working deck.

The vessel comprises a riser handling gantry crane 90 provided with riser hoisting device that allows to raise and lower a riser and displace said riser 71—while maintaining vertical orientation—to and from the riser manipulator 80.

In this example the vessel is provided with a rotary drilling drive, namely a top drive, at the front side of the mast, so that drilling is possible via the front firing line 15*a*. It will be appreciated that a rotary drilling drive could also (or as alternative) be located at the rear side of the mast. Similar the riser storage and handling system could be arranged at the front side of the mast is desired.

The vessel comprises one of more holds 110 in the hull for storing drill string cassettes 120, a cassette having multiple parallel storage slots open from above, each slot adapted to store a stack of multiple drill strings.

The vessel comprises a rail system 130 with one or more rails and one or more associated trolleys, which extend from said one or more holds to the front side of the mast.

A crane 140 is mounted near the front side of the mast, the crane allowing to lift a cassette 120 from a trolley and place it in a storage position 125 near the front side of the mast, wherein the cassette is stored in horizontal orientation.

A drill string manipulator 150, here based on a knuckle boom crane, is arranged at the front side of the mast to remove a drill string from a cassette in horizontal orientation.

The hold 110 comprises vertically spaced floors for storage of cassettes, and an elevator is provided to transfer a cassette upwards to the rail system.

With reference to FIGS. 8, 8A-8C, 9A-9*b*, 10, 11 and 12A-12B now a second preferred embodiment of the monohull offshore drilling vessel according the invention will be discussed.

The vessel 200 has a hull 201 with a bow 202 and a stern 203 and an accommodation topside 204 having crew quarters and a bridge is arranged on the hull at the bow.

The hull has a main deck 210 that extends generally between the accommodation topside 204 and the stern 203 of the vessel. As is preferred the main deck 210 has a uniform height above waterline throughout, allowing easy transport of items as well as walking of crew members over the deck 210.

The vessel 200 has a moonpool 220 that extends through the hull, here in a midsection of the main deck 210 as is preferred. A front main deck portion 210*a* of the main deck extends forward of the moonpool and a rear main deck portion 210*b* of the main deck extends rearward of the moonpool.

The vessel 200 is equipped with a multiple firing line hoist system that is mounted on the hull. The multiple firing line hoist system is generally similar to the system discussed with reference to the first vessel shown in FIGS. 1-5, 6A-6C and 7A-7C. Therefore similar parts have been denoted with the same reference numeral.

The multiple firing line hoist system includes a hollow construction mast 11 having a top side and a base integral with the hull, the base extending between sections of the hull on port and starboard side of the moonpool 220, the base being spaced from the bow side and from the stern side of the moonpool 220, thereby forming a front moonpool area forward of the mast and a rear moonpool area rearward of the mast.

The mast has a front side 13 and an opposed rear side 12 as well as opposed lateral sides.

The top section of the mast supports a crown block 11*a*, which is equipped with a set of sheaves 11*b* for guiding one or more cables that support a load attachment device 14 which is displaceable along a first firing line, here rear firing line, which extends on the outside of and adjacent to the rear side of the mast, so as to allow handling of items passing through the rear moonpool area.

The crown block also supports a set of sheaves 11*c* for guiding one or more cables that support a load attachment device 15 which is displaceable along a second firing line, here front firing line, which extends on the outside of and adjacent to the front side 13 of the mast, so as to allow handling of items passing through the front moonpool area.

The cables, sheaves and associated winches (not shown) form part of first and second hoisting devices allowing to raise and lower each of the load attachment devices 14,15 and items attached thereto.

Figure 11:
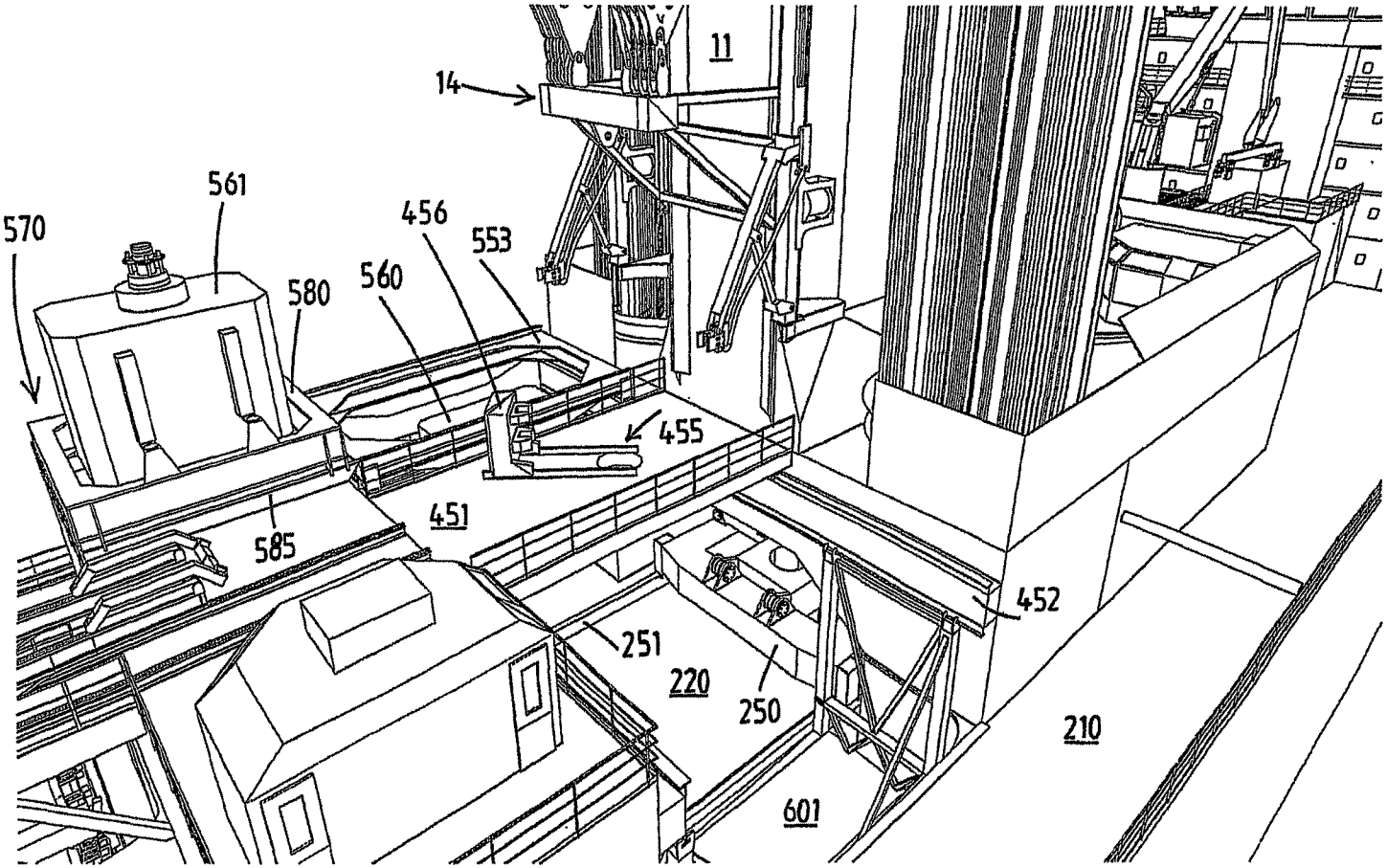
FIG. 11 shows a portion of the vessel of FIG. 8 near the rear side of the mast.

As is preferred, the load attachment devices 14, 15 are combined with trolley members that are guided along vertical guide rails on the corresponding side of the mast, so that the load attachment devices 14, 15 are guided in vertical direction; see FIG. 11 for device 14.

As is preferred the rear load attachment device 14 and the associated hoisting device has a capacity to allow for raising and lowering a riser string with attached BOP. As is preferred the front load attachment device 15 and associated hoisting device has a capacity to allow for lowering and hoisting a drillstring. In a possibly embodiment the hoisting capacity of both hoisting device is the same, e.g. having a static hook load of between 700 and 1200 mt.

It is envisaged that the vessel 200 has a drilling station 400 at the front side of the mast 11. The drilling station 400 includes a drilling deck or drill floor 401 above the front moonpool area. The drilling deck 400, as is preferred, is a stationary deck. The deck has an opening 405 for the passage of tubulars, including a telescopic joint, that can be raised and lowered with the hoisting device 15 at the front side of the mast 11.

The drilling deck may be provided with a rotary table 405 and an iron roughneck, as is preferred. A catwalk machine 402 is arranged in longitudinal direction to feed tubulars, e.g. drill pipes into the front firing line. A driller's cabin 403 is arranged on the drill floor.

It is preferred that the drilling deck 401 is provided with a riser suspension device, e.g. a riser spider, allowing to suspend a riser string, most preferably with a BOP attached to the lower end of the riser string, from the deck 401.

A small crane 410 serves to transfer drill pipes between the drill pipe storage, here in the cassettes 120, and the catwalk machine 402.

It is preferred that the drill floor 401 is arranged at a limited height above the main deck 210, e.g. at a height between 2 and 7 meters above the main deck, preferably about 5 meters.

It is envisaged that the auxiliary station 450 at the rear of the mast 11 is used for auxiliary activities, most preferably at least including BOP handling and riser string assembly. Other activities can obviously also be carried out at this station 450, such as lowering and raising items via the moonpool into the sea.

As is highly preferred, and generally similar to the vessel 1, the station 450 at the rear side of the mast 11 includes a mobile working deck 451 that is displaceable between an active position, wherein the rear firing line extend through an opening 455 in the working deck 451, and a non-active position, in which the BOP can be brought from its storage into the rear firing line. As mentioned before the mobile working deck 451, in its active position, is arranged at such a relatively low height above the water in the moonpool, that the tall BOP can not be brought from its storage and into the rear firing line underneath the mobile working deck 451 in its active position. If the working deck 451 would be a stationary deck of the vessel, it would require the working deck 451 to be at an undesirable great height when crew members would be required to work on said deck.

As is preferred the mobile deck 451 includes a tubular string support member (not shown), e.g. a riser spider, at the opening 455 in the deck 451 allowing to suspend a string, e.g. a riser string, most preferably with BOP attached to the lower end of the riser string, or other tubulars string from the deck 451. It will be understood that this requires the working deck 451, and the rails 452, 453 supporting the deck 451, to be of a heavy load bearing design. In a practical design the string with BOP will weigh at least 200 tonnes, it is preferred that the deck will allow to suspended a string of 600 tonnes or even more.

FIG. 11 shows an iron roughneck 456 positioned on the working deck, here displaceable along rails. It is envisaged in a preferred embodiment that the mast, at its rear side, is provided with a iron roughneck storage compartment to store the iron roughneck. It is preferred that rails on the deck 451 when in active or operational position, are aligned with rails in the compartment allow to displace the iron roughneck over said rails to and from the storage compartment.

At the opening 455 also a rotary table can be provided allowing to impart rotary motion to the supported string.

As is preferred the mobile deck 451, in its active or operational position, is arranged a the same height as the drill floor 401.

As is preferred the mobile deck 451 is supported at its front and rear ends on transverse rails 452 and 453. In a practical embodiment the mobile deck is skidded over said rails.

Another preferred feature of the vessel 200, and also of the vessel 1 shown in FIG. 1, is that the hull 201 has an engine room 280 (see FIG. 8A), or several engine rooms, below the accommodation topside 204, each engine room 280 containing one or more fuel powered engines 281 and generators 282 driven by said one or more engines 281 to provide on-board electrical power. This electrical power is generated to be supplied at least to the one or more electric motors of electric motor powered thrusters 206 that providing propulsion for the vessel. It is envisaged in this preferred embodiment that the one or more exhausts 207 that are associated with the one or more engines 280 extend upward to one or more exhaust outlets 207*a* above the accommodation topside 204.

It is noted that in prior art designs of monohull drilling vessels the engine rooms and the exhausts are located at the stern of the vessel. This is done as drilling operations etc. are commonly done with the bow of the vessel facing into the wind, so the exhaust gasses leave from the stern of the ship.

In the preferred arrangement of the engine room and exhausts discussed here the exhaust gasses will be emitted from the top of the topside 204 and thus will pass over the area of the mast 11, working decks, etc. As the working decks are located at a relatively low level above the waterline and the exhaust outlets are at the top of the topside 204, the vertical spacing is so great that personnel working on the main deck and working deck will not be hindered by said exhaust gasses.

Figure 8:
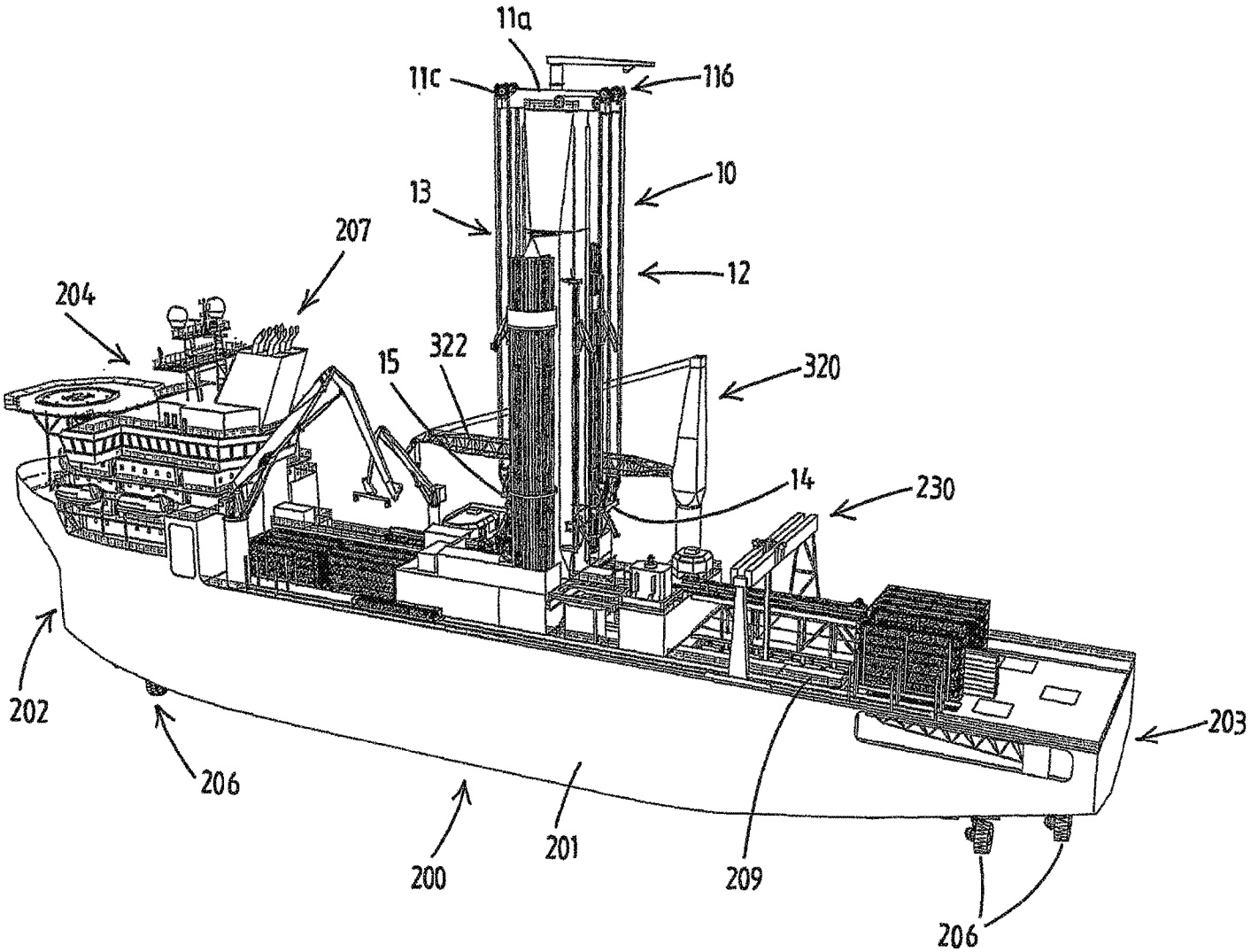
FIG. 8 shows a second example of a monohull drilling vessel according to the invention.
Figure 8A:
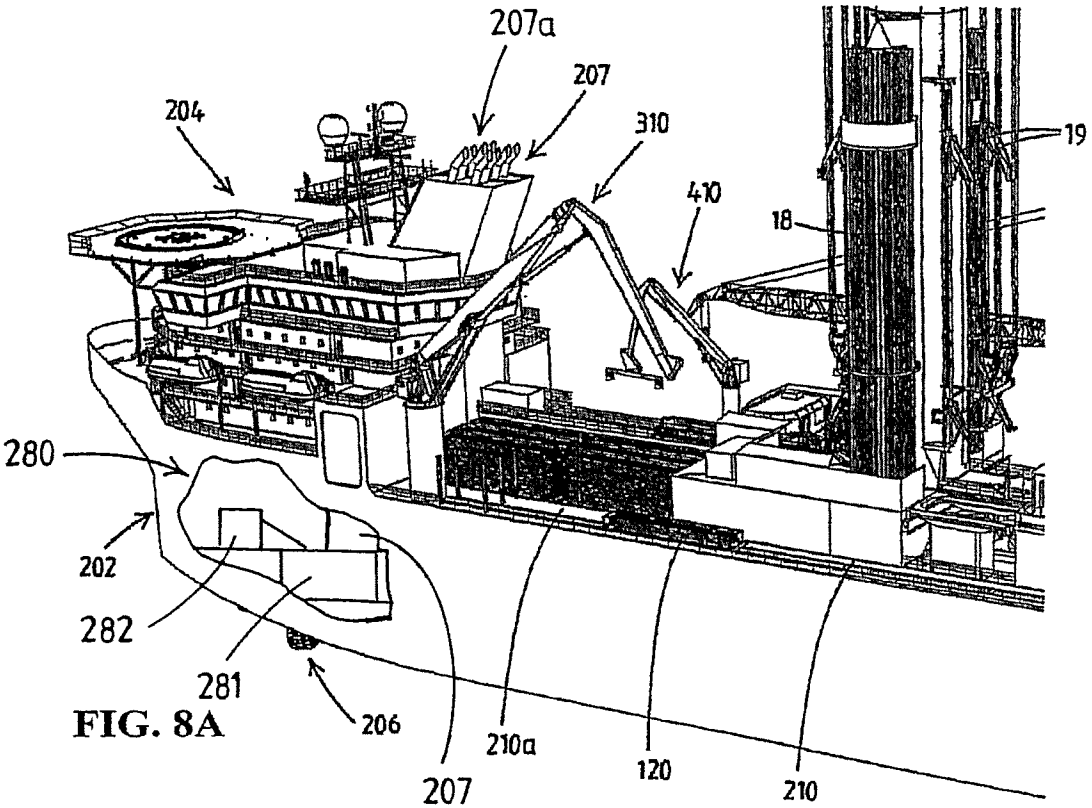
FIG. 8A shows a forward portion of the vessel of FIG. 8 on an enlarged scale.
Figure 8B:
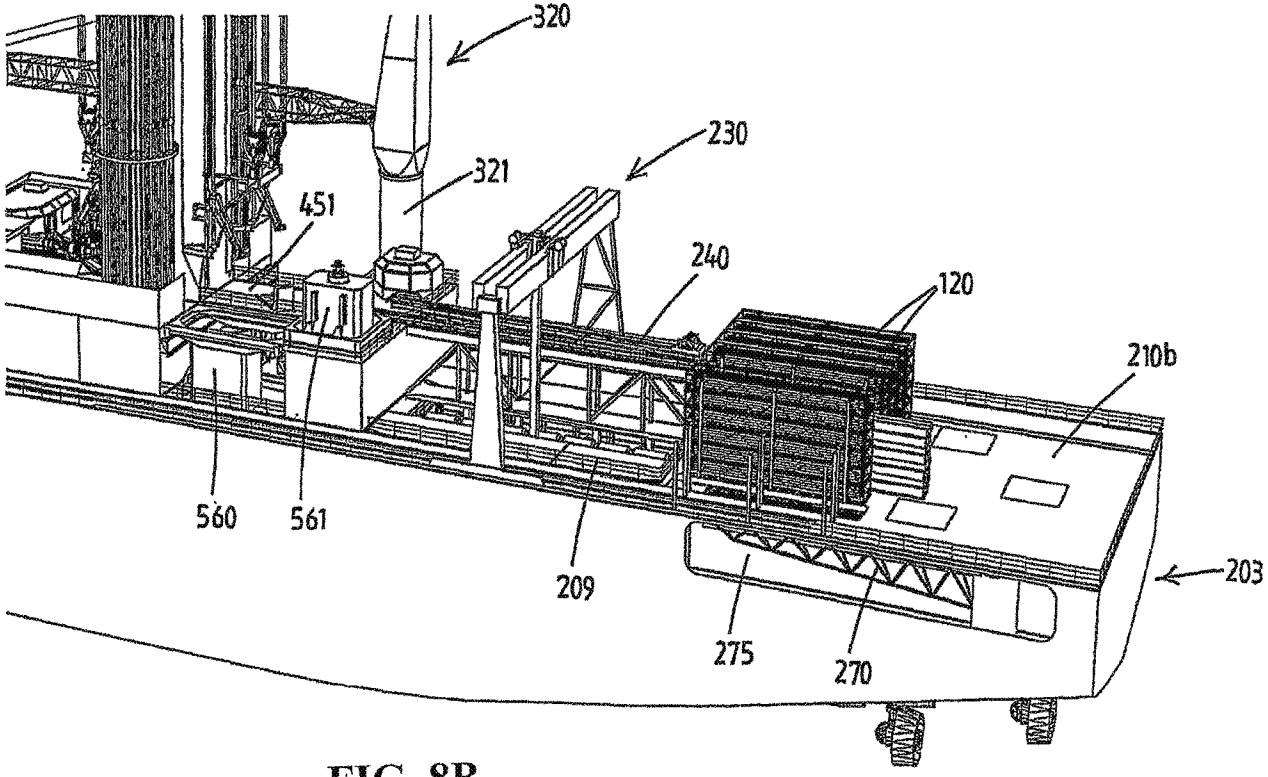
FIG. 8B shows a rearward portion of the vessel of FIG. 8 on an enlarged scale.
Figure 8C:
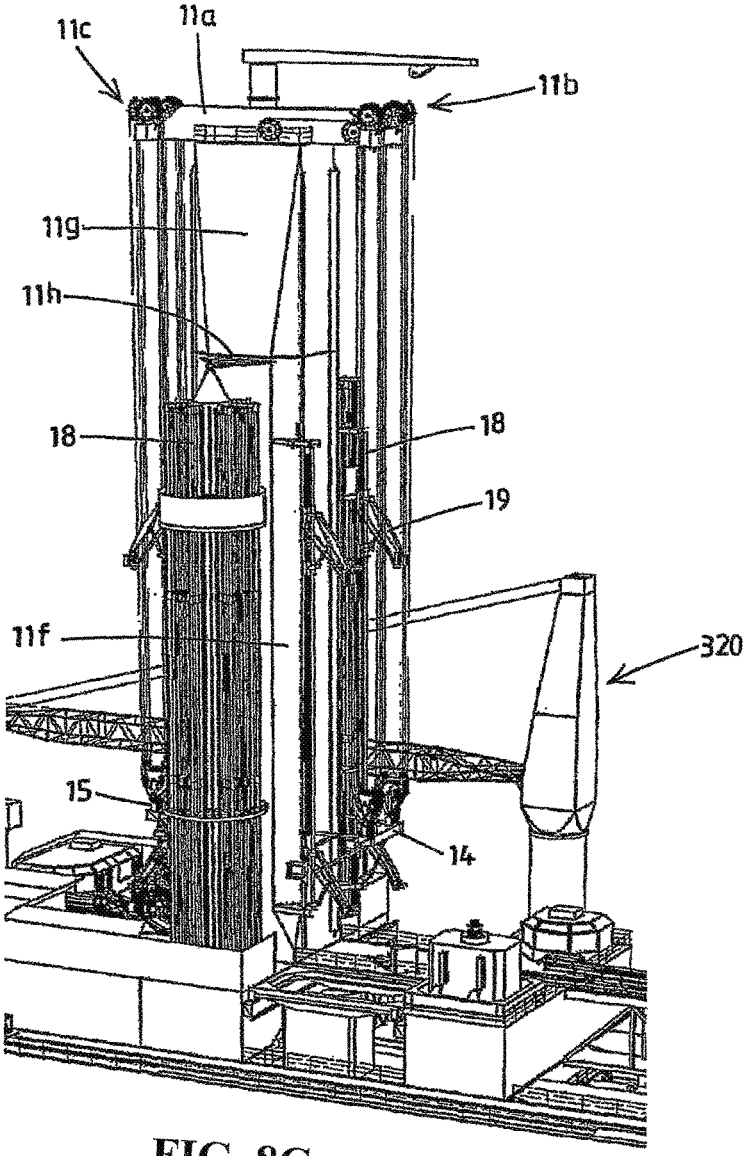
FIG. 8C shows a top portion of the mast of FIG. 8 on an enlarged scale.
Figure 9A:
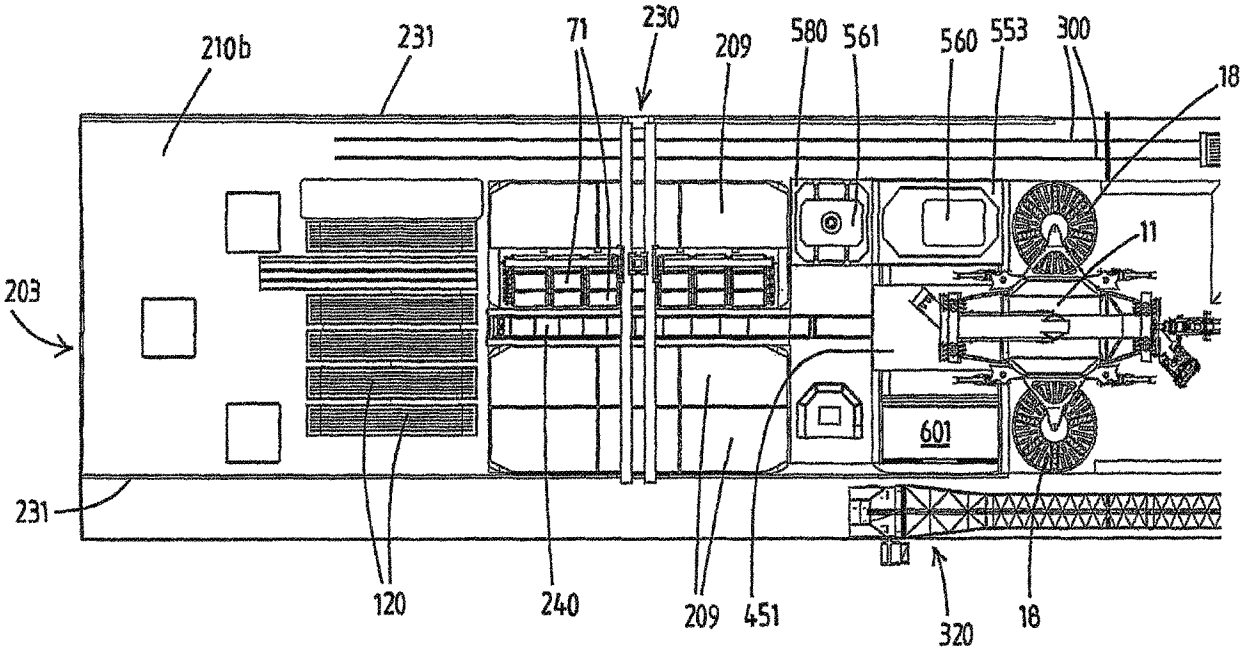
FIG. 9A shows a rearward portion of the vessel of FIG. 8 in view from above.
Figure 9B:
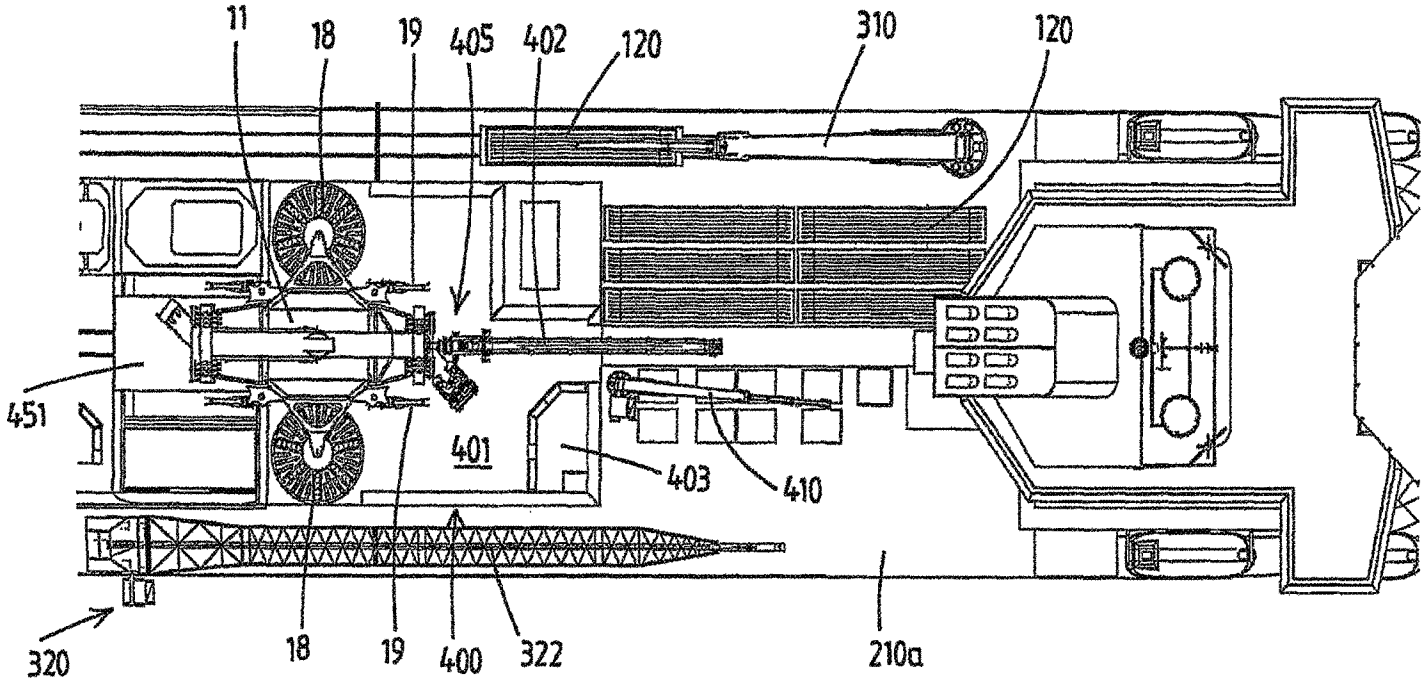
FIG. 9B shows a forward portion of the vessel of FIG. 8 in a view from above.

It is noted that this vertical spacing is primarily created in the vessels 1, 200 shown in FIGS. 1 and 8 by the fact that the working deck at the side of the mast where the BOP handling takes place is a mobile working deck that is cleared from the firing line for handling the tall BOP.

An advantage of this arrangement of the engine room and exhaust, is that the rear main deck portion 210*b* is now embodied to have no exhaust structures for engine exhaust gases as commonly found on prior art vessel, thus allowing this rear main deck portion 210*b*, and in particular the area directly adjacent the actual stern 203 of the vessel, to be embodied as clear deck space for temporary storage of items.

A further preferred feature of the vessel 200 in FIG. 8 is that one or more riser storage holds 209, here two holds arranged side-by-side, are present in the hull below the rear main deck portion 210*b*, so aft of the moonpool 220. In contrast to the vessel 1 in FIG. 1 it is shown here that the risers 71 are stored in horizontal position in the holds, whit the longitudinal axis of the risers 71 l longitudinal direction of the vessel.

A gantry crane 230 is shown, which gantry crane has a vertically displaceable riser lifting part that is adapted to engage on and carry a riser 71 in horizontal orientation, allowing to lift the riser in horizontal orientation from the hold 209 and to lower it into the hold 209. As is preferred the gantry crane has a bridge part that extends in transverse direction of the vessel, and the riser lifting part is supported from a dolly that is displaceable along the bridge part. As in this preferred embodiment the risers are stored in longitudinal direction of the vessel, the riser lifting part is arranged here at right angles to the bridge part.

It is further preferred that the riser lifting part is also adapted to engage on and carry a hatch covering the riser hold 209 in order to open or close the hold 209.

A catwalk machine 240 is shown to extend in longitudinal direction of the vessel 209 above the main deck 210*b*, here at the same level as the working deck at said side of the mast. The gantry crane 230 allows to place a riser 71 in horizontal orientation on the catwalk machine 240 and to remove a riser from the catwalk machine. Catwalk machines are generally known in the art and are used for upending the riser 71, so that an upper end of a riser 71 can be engaged with the load hoisting device 14 at the rear side of the mast 11.

It can be seen that the legs of the gantry crane 230 are supported via wheels on rails 231 which extend in longitudinal direction of the vessel from the stern 203 to the area of the mast 11, as is preferred allowing the gantry crane 230 to be position above the rear moonpool area for crane operations in said area.

In case the mobile working deck 451 would be designed to be vertically displaceable between its active or operative position and a raised non-active position, it is preferred that the raised non-active position is so high that the gantry crane 230 can come underneath the raised mobile working deck.

As is preferred one or the rails 231 is arranged in close proximity to a lateral side of the vessel 200, as is preferred even outside the handrail along said lateral side.

In can be seen that the one or more riser storage holds 209 are arranged rearward from the moonpool 220, a further portion of the rear main deck portion 210*b* forming a clear deck space at least bordering the stern of the vessel. In this example, rearward of the riser holds 209 storage racks for drill pipe cassettes 120 are placed on the deck. Such storage racks may be fastened in a releasable manner to the main deck, allowing for the easy removal when it is desired to use the rear deck portion 210*b* for other purposes.

In particular with reference to FIG. 10 a further preferred feature of the vessel 200 will be discussed now.

Figure 10:
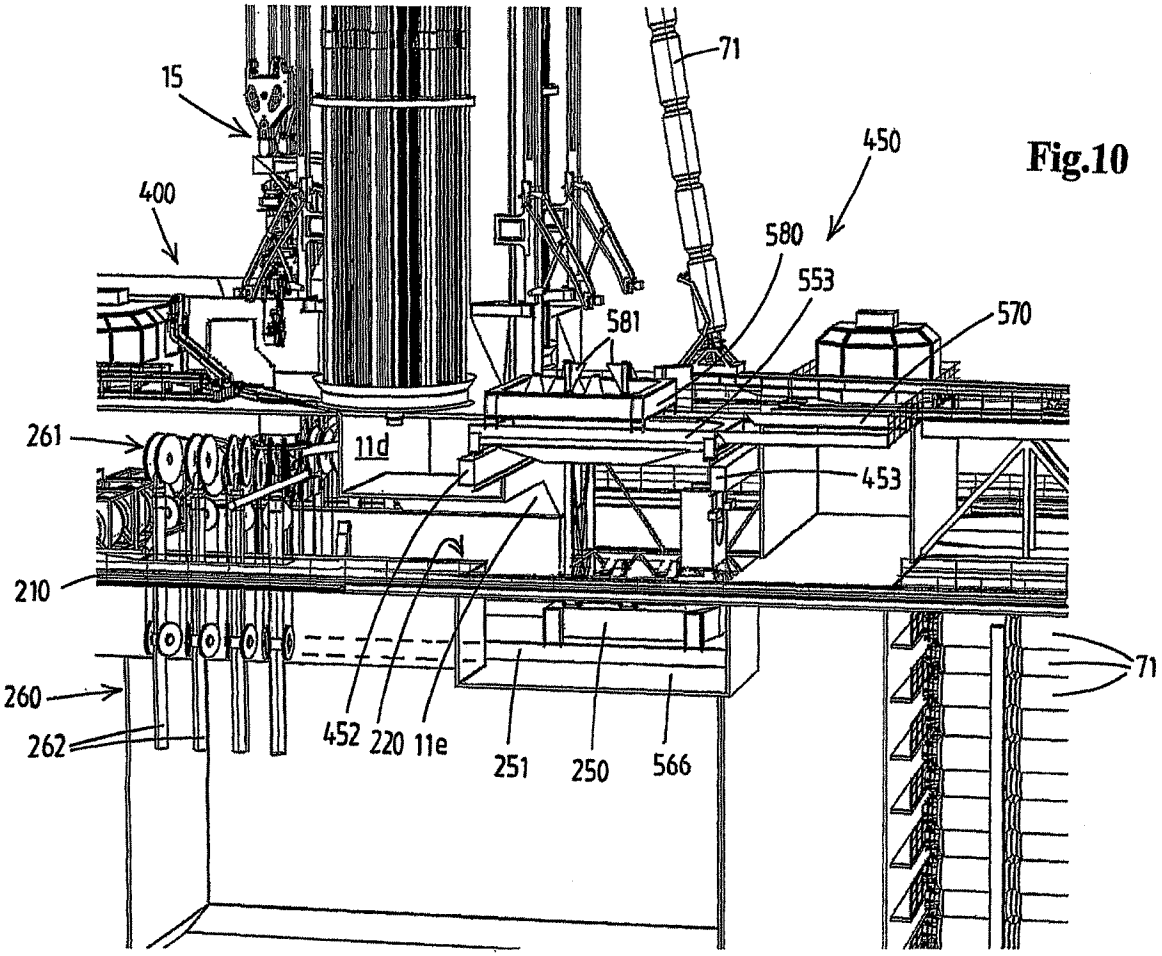
FIG. 10 shows a portion of the vessel of FIG. 8 near the moonpool with the hull partially removed.

In FIG. 10 it can be seen that the base of the mast 11 includes a horizontal box girder 11*d* extending in transverse direction over the moonpool 220, the base further including a leg structure 11*e* at each end of the box girder 11*d* extending downwardly to the main deck 210 level of the hull. As can be seen the lower side of the box girder 11*d* is arranged here above the level of the main deck 210.

FIG. 10 also shows a suspended riser transfer device including a support frame 250, possibly embodied as a skid cart, and a pair of associated rails 251 which extend in longitudinal direction along the moonpool (partly shown in dashed lines as said part is obscured by the moonpool lateral wall), allowing to displace the support frame 250 in longitudinal direction of the moonpool while supporting a riser string of interconnected riser (and possibly a BOP attached to the lower end of the riser string) lowered into the sea, generally between the rear moonpool area and the front moonpool area.

The support frame 250 may have a, preferably U-shaped with the opening towards the front moonpool area, frame of beams. The frame preferably has one or more mobile riser suspension members for suspending the riser string and attached BOP.

It is envisaged that when a riser string is transferred between the rear and front moonpool area by means of the support frame 250, the top end of the riser string is provided with a flexible element, e.g. providing some gimballing effect, allowing angular motion of the riser string with respect to the support frame in order to avoid undesirable stresses. It is envisaged that such a flexible element is also used when the riser string is suspended from the deck 451 and from the deck 401.

Possibly the frame 250 has a central opening, possibly with the one or more mobile riser string support members in non-active position, allowing for the passage of the BOP through the central opening, after which passage the one or more mobile support members can be moved into active position so as to engage on the top end of the riser string. In a preferred embodiment the support frame 250 is provided with suitable BOP guide members for the BOP that allow to guide, in particular stabilize against sideways motions, the BOP during lowering and raising through the splash zone in the moonpool.

In a preferred embodiment one or more of the support frames 553, 580 of the BOP transfer device are provided with BOP suitable guide members for the BOP that allow to guide, in particular stabilize against sideways motions, the BOP during lowering and raising through the splash zone in the moonpool.

FIG. 10 also shows that a riser tensioner system is arranged at the front moonpool area, the riser tensioner system 260 including a set of sheaves 261 at each lateral side of the moonpool and in the hull section at the lateral side of the moonpool a set of vertically arranged hydraulic tensioner cylinders 262. Via a tensioner ring or similar (not shown) cables of the riser tensioner system can be fastened to the riser string.

It will be appreciated by the skilled person that the vessel 200 allows to built and lower a riser string with BOP attached to the lower end thereof at the rear side of the mast, then to suspend said riser string from the support frame 250, displace the support frame 250 with the riser string to the front moonpool area, and suspend the riser string from the riser tensioner system 260. As will be explained it is envisaged here that the drill string is assembled and disassembled at the front side of the mast 11 and drilling is effected at the front side of the mast.

Two set-backs, here carrousels, 18 for vertical storage of drill pipe joints, in this example quad joints of about 40 meters, are arranged at opposed lateral sides of the mast 11. Two pipe joint handlers, or pipe rackers, arranged at the front of the mast allow to transfer drill pipe joints between each of the carrousels 18 and the front firing line. Similarly two pipe joint handlers at the rear of the mast 11 allow to transfer drill pipe joints to the rear firing line.

A further preferred feature of the vessel 200 relates to the arrangement of burner booms 270 on the vessel. Burner booms 270 are common on drilling vessels to allow for the flaring of hydrocarbon products when desired.

The vessel 200 has two pivotal burner booms 270, each burner boom having an inner portion pivotally mounted at a lateral side of the hull 201 and an outer portion of the boom supporting one or more burners. Each burner boom 270 is pivotable between a storage position generally parallel to the lateral side of the hull 201 and an operative position wherein the boom is directed away from the hull, preferably the burner being beyond the stern of the vessel so that the flare is remote from the main deck 210*b*.

According to the preferred feature each burner boom 270 is stored in the storage position at a height lower than the level of the main deck 210, the burner boom most preferably being located in a rear section of the lateral side of the hull, so generally below the level of the rear main deck portion 210*b*. Hereby no deck space is required for the burner booms and the burner booms (in storage position) do not obstruct activities such as placing items on the rear deck portion with a crane.

Most preferably, as in the vessel 200, the lateral side of the hull has a recessed storage space 275 for the burner boom 270, such that the stored burner boom 270 does not project beyond the plane of the lateral side of the hull of the vessel. Hereby the burner boom is effectively hidden within the hull of the vessel and is shielded from damage. In addition the burner boom does not hinder other activities on the vessel.

As in the vessel 200 it is preferred that the burner boom 270 is a cantilever boom, that is solely supported at its inner portion which is pivotally mounted to the hull via a pivot structure supporting the entire weight of the boom.

In a further preferred embodiment of the mast of the vessels 1 and 200, the hollow construction of the mast is provided with a rotary drilling top drive storage compartment (here at the front of the mast; not shown) having an access opening for the top drive at the front and/or rear side of the mast, adapted to store a rotary drilling top drive when not in use, said storage compartment preferably being accessible for personnel via a stairs structure within the mast and/or an elevator within the mast, wherein preferably the storage compartment is equipped with a door to close the access opening.

The provision of this top drive storage compartment allows for efficient maintenance of the top drive as it is positioned in the compartment. This compartment may e.g. be arranged halfway up the mast.

Preferably a movable support assembly, e.g. telescopic horizontal support beams, with associated drive means, e.g. one or more hydraulic cylinders, is provided at the rotary drilling storage compartment, said support assembly in an extended position allowing to receive the rotary drilling top drive whilst in the firing line and in an retracted position allowing to support the top drive within the storage compartment.

For the mast of the multiple firing line hoisting system it is in general considered advantageous, in particular if the mast has a height such that it can handle triple or quad drill pipe joints (36 or 48 meters), to equip the mast internally with a passenger elevator having an elevator cab and associated hoist means allowing crew members to reach equipment and/or compartment high up in the mast, preferably reaching at least to the top end of the carrousels or other drill pipe joint storage devices fitted to the mast.

A further preferred feature of the vessel 200 relates to a rail transportation system that is mounted on the main deck 210 of the vessel. This system has one or more rails, here a pair of parallel rails forming a longitudinal track 300 alongside a lateral side of the hull of the vessel 200. The system further has one or more associated trolleys 301, possibly wheeled trolleys with rail engaging wheels.

As can be seen in FIG. 8, and as is preferred, the track 300 extends in longitudinal direction on the main deck 210 between the rear main deck portion 210*b* and the front main deck portion 210*a* and passes along a side of the moonpool 220 and the mast 11, so allowing e.g. to transport items from the rear main deck portion 210*b* to the front main deck portion 210*a*, and vice versa, and also to and from the area near the moonpool 220 and the mast 11.

As an example the vessel 200 shown here is carrying drill pipe cassettes 120 on and possibly also below the rear main deck portion 210*b*. These cassettes are transported, e.g. one at the time, to the front main deck portion 210*a* (to be used for drilling activities at the front of the mast) by one or more trolleys 301 travelling over the track 300.

It can be seen that between the topside 204 and the area of the moonpool 220 and the drilling station at the front side of the mast, the main deck 210*a* is in this example used for storage of drill pipes, here storage of cassettes with drill pipes. It is envisaged that in the vessel 200 may, in addition to the storage on deck portion 210*a* or as alternative have one or more holds for drill pipes (possibly in cassettes) in the hull below said deck portion 210*a*.

In combination with the longitudinal track 300 it is considered advantageous if the gantry crane 230 extends over said track 300 to handle items to be transported, such as the cassettes 120, via said track.

As is preferred a crane 310 is arranged near the forward end of the track 300 in order to allow for loading and offloading items onto and from the trolleys 301 on the track 300. As is preferred this crane 310 is a knuckle boom crane on front main deck portion to handle items, e.g. transported via said track.

A further preferred feature of the mast of the vessel 200 relates to the height of the mast 11 and the deployment of the vessel 200 to various geographical areas. As is known relevant nautical passages, such as the Panama canal, Suez canal and Bosporus are spanned by bridges allowing passage only for vessel having a maximum height of about 58 meters. As is preferred, and incorporated in the mast 11, drilling activities with the vessel 200 are to be conducted with quad drill pipe joints, having a length of 41 meters. The mast 11 then will have a height above the maximum of 58 meters.

In order to allow for a height reduction of the mast 11, it is in a variant of the mast 11 envisaged that the mast 11 is composed of a lower mast section 11*f* integral with the base, and a removable top mast section 11*g*. In FIG. 8 the division is indicated as 11*h*.

As is preferred the lower mast section 11*f* supports the carrousels 18 or similar drill pipe joint storage devices. The top mast section 11*g* includes the crown block 11*a* with the sets of sheaves 11*b, c* and an axial portion of the hollow mast body, e.g. having a length of between 5 and 15 meters.

The lower mast section 11*f* and the top mast section 11*g* are interconnected by one or more releasable fastening devices. Preferably these fastening devices can be reached, or most preferably are arranged, within the hollow construction of the mast 11. In a practical embodiment the releasable fastening devices include a plurality of bolts, e.g. the lower mast section being fitted with bolts that fit through holes in an internal annular flange of the top mast section.

In order for the vessel 200 to be self-supporting as regards the removal and replacement of the detachable top mast section 11*g*, it is preferred that the vessel has a crane allowing to engage on the top mast section whilst supported on the lower mast section and lower the top mast section, after release from the lower mast section has occurred, down to the main deck of the vessel, or e.g. onto another vessel moored along the vessel 200, and vice-versa. With this on-board crane the removal and replacement of the top mast section can even be done during sailing of the vessel, thereby avoiding the need to visit a port for this activity and thus shortening the sailing time.

In the example of vessel 200 a pedestal crane 320 is mounted near the mast 11, here at a lateral side of the deck 210 opposite from the side with the track 300. This crane 320 is suitable for the purpose of removal and replacement of the detachable top mast section 11*g*. The crane 320 has a pedestal 321 and a main boom 322 with associated luffing and main hoist cables and winches. The main boom 322 is of insufficient length to reach above the top of the mast 11, so, as is preferred, and extension boom (not shown) is associated with the crane 320. This extension boom can be mounted on the main boom 322 to extent the reach of the crane 320 so as to allow to engage on the top mast section 11*g* whilst supported on the lower mast section 11*f*. It is preferred, for storage on board of the vessel, that the extension boom is composed of boom sections that are fastenable to each other end-to-end, preferably the sections having a length of 6 meters (20 feet), e.g. so as to allow transport as a standard ISO container.

In another design of the crane 320 the main boom 322 is designed as a telescopic main boom, so that in the extended state the main boom can be used to pick-up the top mast section 11*g*.

With reference to FIGS. 10, 11 and 12A-12B now a preferred embodiment of preferred details thereof with regard to handling of the BOP at the auxiliary station 450 will be discussed.

As already mentioned the station 450 includes a mobile working deck 451 that is displaceable to a non-active or retracted position in order to allow for the BOP to be brought in the rear firing line and to engage on the BOP with the load hoist device 14 at said rear side of the mast 11.

As can be seen the BOP storage is laterally offset from the rear firing line, and a BOP transfer device is provided for lateral displacement of the BOP into the firing line.

In this example, as is a preferred embodiment, the BOP is a splittable BOP that is composed of a lower main body element 560 and an upper main body element 561 having connectors so that said BOP is splittable into said two main body elements 560, 561. The upper main body element 561 may be a LMRP (Lower Marine Riser Package) and the lower main body element 560 a SSBOP (subsea BOP) as is known in the art.

As the BOP is splittable here, it is envisaged that the lower main body element 560 is stored in a storage compartment 565 directly adjacent the moonpool 220, the floor 566 of said compartment being arranged lower than the main deck 210.

As is a preferred embodiment, for the upper main body element 561 a storage position 570 is provided, here a storage platform, at the same side of the moonpool as compartment 565, yet rearward offset in longitudinal direction with regard to the compartment 565 and at a height above the top end of the stored lower main body element 560. A support frame 580 for the upper main body element 561 is provided, as well as a set of rails 585 extending in longitudinal direction on the storage platform 570.

The support frame 580, rectangular in this example, has a central opening such that the element 561 can extend through said opening upon lowering and raising of the BOP. The support frame 580 is provided with actuable BOP supports 581 that in active position support the element 561 (and when connected thereto the element 560 also) and in retracted position release the BOP, so that the BOP may be lowered into the sea by means of the hoisting device of the mast.

A further support frame 553 is displaceable over rails that extend from the compartment 565 where the element 560 is stored to at least across the rear moonpool area, generally to allow to bring the element 560 (and the element 561 connected thereto) into the rear firing line. As is preferred these rails are the same rails 452, 453 as over which the working deck 451 is displaceable. The rails 452, 453 are spaced apart so as to allow the BOP to pass through.

This further support frame 553 has rails 555 that can be brought (by positioning of the support frame 553) in line with the rails 585, then allowing to transfer the support frame 580 with the element 561 between the storage position 570 and a position on the support frame 553 and also above the lower element 560.

The vessel 200 is provided with suitable lifting means to lift the stored lower element 560 so as to engage from beneath on the upper element 561 that is held by the support frame 580 placed on the support frame 553. As is preferred the lifting means are integrated with a test stump 590 for the BOP, here embodied as one or more hydraulic cylinders 591 engaging on the test stump 590 and allowing for controlled vertical displacement of the test stump with at least the lower element 560 of the BOP resting on the test stump.

Figure 12A:
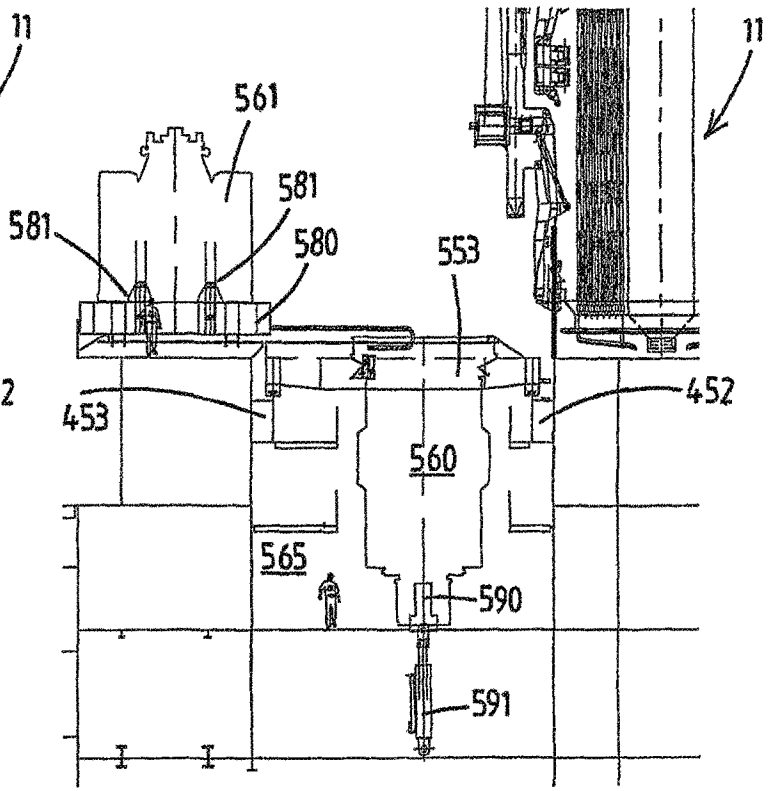
FIGS. 12A and 12B show in longitudinal cross-section of the vessel the portion containing the BOP transfer device of the vessel of FIG. 8, FIGS. 13 and 14 show an alternative arrangement of the mobile working deck in a vessel according to the invention.
Figure 12B:
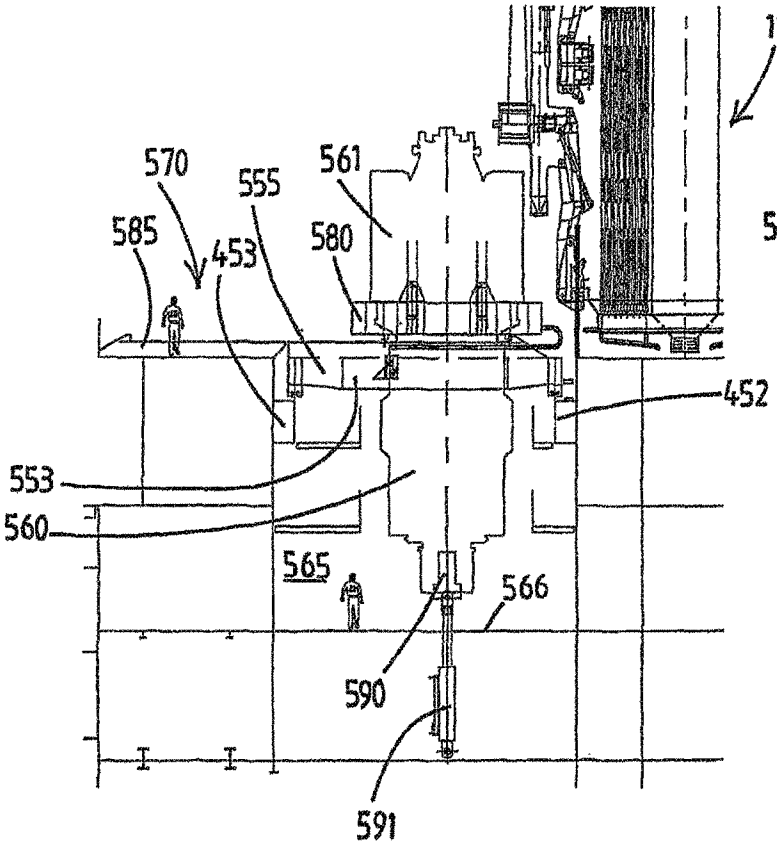

As can be seen in FIGS. 12A and 12B the upper element 561 can be brought into alignment with the lower element 560 by displacing the support frame 580 onto the frame 553 and then the lower element 560 can be raised with the test stump 590 by means of cylinder 591. The interconnection between the elements 560 and 561 can then be established and, possibly after some further testing of the BOP, the test stump can be lowered so that the entire BOP becomes suspended from the support frames 580, 553. Then the mobile working deck 451 is displaced away from the firing line and the support frame 553 (with frame 580 on top) carrying the BOP is brought into said firing line. For instance a riser 71 is then connected to the upper end of the BOP and connected to the hoisting device of the mast 11 and the weight of the BOP absorbed by the hoisting device. Then the actuable BOP supports 581 are retracted, so that the BOP can the be lowered along the firing line.

The riser and BOP connected thereto may be supported from the support frame 250 arranged within the moonpool below the working deck 451 as explained before.

As is preferred the vessel 200 also includes an X-mas tree storage compartment 600 adjacent the moonpool, as is preferred opposite from the BOP storage, and an X-mas tree transfer device is provided for displacement of the X-mas tree into the rear firing line of the hoist system. The X-mas tree transfer device here includes a X-mas tree support frame 601 that is suspended from the rails 452, 453. As the X-mas tree may be less high than the BOP it is envisaged that the X-mas tree can be brought into the rear firing line underneath the mobile working deck 451.

In an embodiment not shown in the drawings the X-mas tree storage compartment 600 is envisaged to store an X-mas tree having a height that exceeds the free height under the working deck 451. It can also be envisaged that instead of said X-mas tree storage compartment 600, a second BOP storage compartment is provided adjacent the moonpool, at the lateral side opposite from the first BOP storage compartment. For these embodiment it is envisaged that the X-mas tree transfer device, or the second BOP transfer device, include a support frame that is supported on the rails 452, 453 similar to the frame 553. It will be appreciated that in this arrangement the working deck can not be moved sideways as the space at either side of the working deck 451 will be occupied by a support frame. It is thus preferred in said arrangement that the working deck 451 is liftable to a raised, non-active position, so as to allow the one or more BOP's or the X-mas tree to be moved from its storage compartment into the firing line underneath the raised working deck.

With referral to FIGS. 13 and 14 now an alternative arrangement of the mobile working deck in a vessel according to the invention will be discussed. Parts of the vessel that have been explained earlier have been denoted with the same reference numeral.

Figure 13:
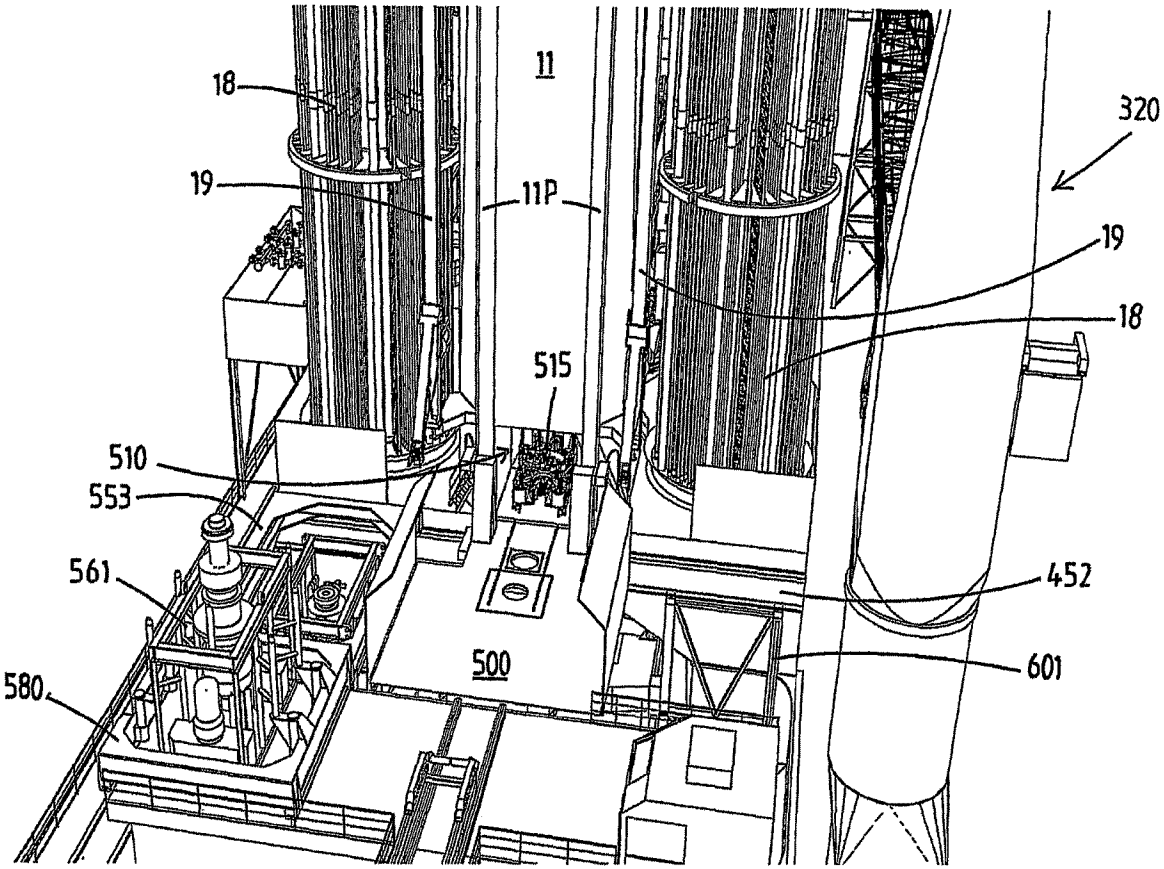
Figure 14:
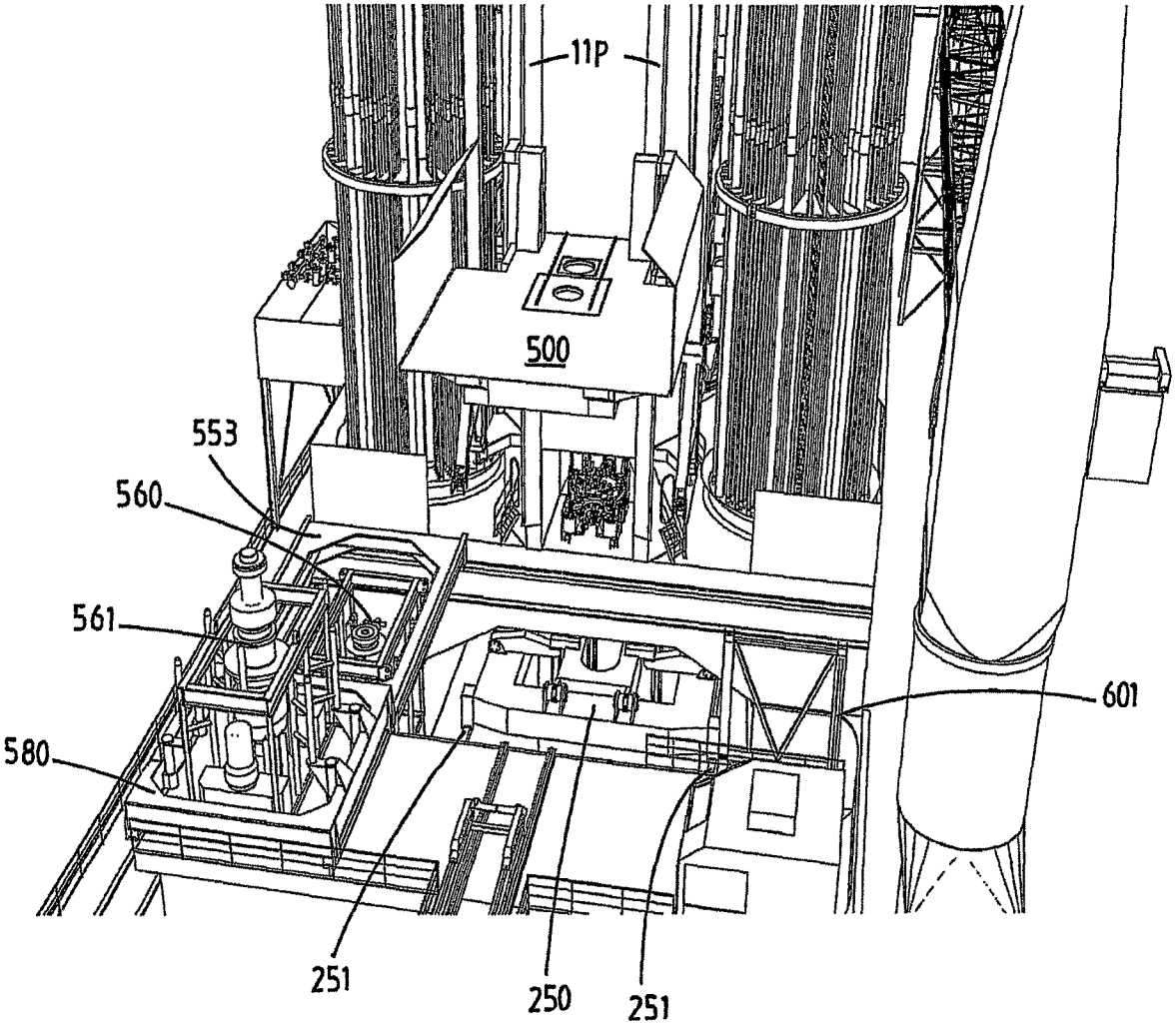

In FIGS. 13 and 14 the working deck 500 is vertically liftable between a lower active or operative position (shown in FIG. 13) and a raised, non-operative position (FIG. 14), e.g. at least 5 meters above the active position. In this example the mast 11 is provided with vertical guide means (here as is preferred the same vertical rails 11*p* that guide the trolley of the load attachment device 14 along the mast) for the working deck 500. As is preferred the mast is provided with dedicated hoisting means for the liftable working deck 500, e.g. one or more winches and associated lifting cables, the winches preferably being housed with the mast.

As can be seen in FIGS. 13, 14 a iron roughneck storage compartment 510 is provided in the mast 11, and an iron roughneck 515 is shown stored therein. Also shown are rails for the iron roughneck, both on the working deck 500 and in the compartment 510, as is preferred. As is preferred this compartment 510 is provided with a door (not shown).

As is preferred the working deck 500 is provided with side wall panels 520, providing some shielding against the weather.

The skilled person will appreciate that vessels described herein allow for highly effective drilling operations to be performed. The vessels in particular allow to lower a BOP and associated riser string at one firing line, using an auxiliary working deck, possibly with inclusion of a telescopic joint at the top end, and then to suspend said riser string from a support frame that is displaceable along the length of the moonpool underneath the base of the mast, so that the riser string is then brought in the other firing line, wherein drilling operations are then performed from a drilling deck. Most advantageous the auxiliary working deck is a mobile working deck as described herein, allowing said deck to be—when in use—at a relatively low level above the waterline, while allowing to bring a tall BOP or X-mas tree into the firing line when the mobile deck is in its non-active position.

In one exemplary method of operation of such a vessel the following main steps are envisaged:

moving the mobile working deck into its non-active position to clear the space at the respective firing line for placement of a BOP, which would otherwise be impossible due to the presence of the mobile working deck, bringing the BOP to a position in said firing line with the BOP transfer device, connecting a riser to the BOP to form an assembly, suspending the assembly from the respective hoisting device at said firing line, lowering the assembly and suspending it from the riser suspension device on the support frame in the moonpool, allowing to disconnect the hoisting device from said assembly, replacing the mobile working deck at its active or operative position, reattaching the hoisting device to the assembly and lifting the assembly to suspend the assembly from the mobile working deck, adding risers to the assembly and lowering the assembly in a step-by-step manner to a completed assembly, lowering the completed assembly and suspending it from the support frame in the moonpool, transferring said support with suspended riser assembly to the other firing line beneath a drilling deck of the vessel.

When said last mentioned situation is reached several possibilities exits for completion of the operation, for instance:

raising the assembly to the level of the drilling deck, so as to suspend the assembly from the drilling deck, connecting a telescopic joint to the top end of the assembly, lowering the assembly, so as to engage the assembly with a cable type riser tensioner system arranged on board of the vessel at said side of the moonpool.

As an alternative a direct acting riser tensioner device could be connected to the top end of the riser assembly, and then the assembly could be lowered using the hoisting device at said side.

What is claimed is:

1. An offshore drilling vessel comprising:

a hull having a moonpool, a bow and a stern;

an accommodation topside having crew quarters and a bridge, said accommodation topside being arranged on the hull at the bow;

a main deck between the accommodation topside and the stern of the vessel, wherein a front main deck portion of the main deck extends forward of the moonpool and a rear main deck portion of the main deck extends rearward of the moonpool;

a firing line hoist system mounted on the hull at said moonpool, comprising:

a drilling structure; and a hoisting device supported by the drilling structure and having a load attachment device displaceable along a firing line, the hoisting device including one or more cables and one or more associated winches to manipulate the position of the load attachment device relative to the drilling structure; and one or more pivotal burner booms, each burner boom having an inner portion pivotally mounted at a lateral side of the hull and an outer portion supporting a burner, the burner boom being pivotable between a storage position generally parallel to the side of the hull and an operative position wherein the boom is directed away from the hull, the burner boom in the storage position being lower than the level of the main deck, wherein the lateral side of the hull has a recessed storage space for the pivotal burner boom, such that the stored pivotal burner boom in the storage position does not project beyond the plane of the lateral side of the hull of the vessel.

2. The offshore drilling vessel according to claim 1, wherein the pivotal burner boom is located in a rear section of the lateral side of the hull.

3. The offshore drilling vessel according to claim 2, wherein the pivotal burner boom in the operative position is directed away from the hull and beyond the stern of the vessel so that a flare is remote from the main deck.

4. The offshore drilling vessel according to claim 1, wherein the outer portion of the pivotal burner boom supports one or more burners.

5. The offshore drilling vessel according to claim 1, wherein the pivotal burner boom in the operative position is directed away from the hull.

6. The offshore drilling vessel according to claim 1, wherein the burner boom is a cantilever boom, that is solely supported at its inner portion which is pivotally mounted to the hull.

7. The offshore drilling vessel according to claim 1, wherein the vessel is a monohull vessel.

8. The offshore drilling vessel according to claim 1, wherein the vessel is a semi-submersible.

9. The monohull offshore drilling vessel according to claim 1, wherein the hull further comprises one or more riser storage holds below the rear main deck portion.

10. An offshore drilling vessel comprising:

a hull having a moonpool, a bow and a stern;

an accommodation topside having crew quarters and a bridge, said accommodation topside being arranged on the hull at the bow;

a main deck between the accommodation topside and the stern of the vessel, wherein a front main deck portion of the main deck extends forward of the moonpool and a rear main deck portion of the main deck extends rearward of the moonpool;

a firing line hoist system mounted on the hull at said moonpool, comprising:

a drilling structure, wherein the drilling structure is a hollow construction mast having a top side and a base connected to the hull, wherein the base of the mast extends between sections of the hull on port and starboard side of the moonpool, the base being spaced from the bow side and from the stern side of the moonpool, thereby forming a front moonpool area forward of the mast, comprising a front firing line, and a rear moonpool area rearward of the mast, comprising a rear firing line; and a hoisting device supported by the drilling structure and having a load attachment device displaceable along a firing line, the hoisting device including one or more cables and one or more associated winches to manipulate the position of the load attachment device relative to the drilling structure; and one or more pivotal burner booms, each burner boom having an inner portion pivotally mounted at a lateral side of the hull and an outer portion supporting a burner, the burner boom being pivotable between a storage position generally parallel to the side of the hull and an operative position wherein the boom is directed away from the hull, the burner boom in the storage position being lower than the level of the main deck, wherein the lateral side of the hull has a recessed storage space for the pivotal burner boom, such that the stored pivotal burner boom in the storage position does not project beyond the plane of the lateral side of the hull of the vessel.

11. The offshore drilling vessel according to claim 10, wherein the pivotal burner boom is located in a rear section of the lateral side of the hull.

12. The offshore drilling vessel according to claim 11, wherein the pivotal burner boom in the operative position is directed away from the hull and beyond the stern of the vessel so that a flare is remote from the main deck.

13. The offshore drilling vessel according to claim 10, wherein the outer portion of the pivotal burner boom supports one or more burners.

14. The offshore drilling vessel according to claim 10, wherein the pivotal burner boom in the operative position is directed away from the hull.

15. The offshore drilling vessel according to claim 10, wherein the burner boom is a cantilever boom, that is solely supported at its inner portion which is pivotally mounted to the hull.

16. The offshore drilling vessel according to claim 10, wherein the vessel is a monohull vessel.

17. The offshore drilling vessel according to claim 10, wherein the vessel is a semi-submersible.

18. The monohull offshore drilling vessel according to claim 10, wherein the hull further comprises one or more riser storage holds below the rear main deck portion.

19. An offshore drilling vessel comprising:

a hull having a moonpool, a bow and a stern;

an accommodation topside having crew quarters and a bridge, said accommodation topside being arranged on the hull at the bow;

a main deck between the accommodation topside and the stern of the vessel, wherein a front main deck portion of the main deck extends forward of the moonpool and a rear main deck portion of the main deck extends rearward of the moonpool;

a firing line hoist system mounted on the hull at said moonpool, comprising:

a drilling structure; and a hoisting device supported by the drilling structure and having a load attachment device displaceable along a firing line, the hoisting device including one or more cables and one or more associated winches to manipulate the position of the load attachment device relative to the drilling structure; and wherein the firing line hoist system is a multiple firing line hoist system comprising: a rear hoisting device supported by the drilling structure and having a load attachment device displaceable along a rear firing line, which extends on the outside of and adjacent to a rear side of the drilling structure; and a front hoisting device supported by the drilling structure and having a load attachment device displaceable along a front firing line, which extends on the outside and adjacent to a front side of the drilling structure; and one or more pivotal burner booms, each burner boom having an inner portion pivotally mounted at a lateral side of the hull and an outer portion supporting a burner, the burner boom being pivotable between a storage position generally parallel to the side of the hull and an operative position wherein the boom is directed away from the hull, the burner boom in the storage position being lower than the level of the main deck, and wherein the lateral side of the hull has a recessed storage space for the pivotal burner boom, such that the stored pivotal burner boom in the storage position does not project beyond the plane of the lateral side of the hull of the vessel.

20. The offshore drilling vessel according to claim 19, wherein the pivotal burner boom is located in a rear section of the lateral side of the hull.

21. The offshore drilling vessel according to claim 20, wherein the pivotal burner boom in the operative position is directed away from the hull and beyond the stern of the vessel so that a flare is remote from the main deck.

22. The offshore drilling vessel according to claim 19, wherein the outer portion of the pivotal burner boom supports one or more burners.

23. The offshore drilling vessel according to claim 19, wherein the pivotal burner boom in the operative position is directed away from the hull.

24. The offshore drilling vessel according to claim 19, wherein the burner boom is a cantilever boom, that is solely supported at its inner portion which is pivotally mounted to the hull.

25. The offshore drilling vessel according to claim 19, wherein the vessel is a monohull vessel.

26. The offshore drilling vessel according to claim 19, wherein the vessel is a semi-submersible.

27. The monohull offshore drilling vessel according to claim 19, wherein the hull further comprises one or more riser storage holds below the rear main deck portion.

28. The monohull offshore drilling vessel according to claim 19, wherein the rear hoisting device is adapted to build and lower a riser string with the blowout preventer at the rear side of the drilling structure, and wherein a drill string is assembled and disassembled at the front side of the drilling structure and drilling is effected at the front side of the drilling structure.

* * * * *